US009732992B2

(12) United States Patent
Yamashita

(10) Patent No.: US 9,732,992 B2
(45) Date of Patent: Aug. 15, 2017

(54) AIR-CONDITIONING APPARATUS FOR PREVENTING THE FREEZING OF NON-AZEOTROPIC REFRIGERANT

(75) Inventor: Koji Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 1106 days.

(21) Appl. No.: 13/882,815

(22) PCT Filed: Jan. 27, 2011

(86) PCT No.: PCT/JP2011/000447

§ 371 (c)(1),
(2), (4) Date: May 1, 2013

(87) PCT Pub. No.: WO2012/101677

PCT Pub. Date: Aug. 2, 2012

(65) Prior Publication Data

US 2013/0219940 A1 Aug. 29, 2013

(51) Int. Cl.
*F25D 17/00* (2006.01)
*F25B 29/00* (2006.01)
(Continued)

(52) U.S. Cl.
CPC ..... *F25B 29/003* (2013.01); *F25B 1/00* (2013.01); *F25B 13/00* (2013.01); *F25B 25/005* (2013.01);
(Continued)

(58) Field of Classification Search
CPC ..... F25B 1/00; F25B 13/00; F25B 29/003; F25B 49/02; F25B 2313/0231; F24F 2011/0087
See application file for complete search history.

(56) References Cited

U.S. PATENT DOCUMENTS 9,212,825 B2 * 12/2015 Wakamoto ..... F24F 3/06
9,441,851 B2 * 9/2016 Motomura ..... F24F 11/02
(Continued)

FOREIGN PATENT DOCUMENTS

EP 0 675 331 A2 10/1995
JP 09-196489 A 7/1997
(Continued)

OTHER PUBLICATIONS

International Search Report of the International Searching Authority mailed Mar. 8, 2011 for the corresponding international application No. PCT/JP2011/000447 (with English translation).
(Continued)

*Primary Examiner* — Ljiljana Ciric
(74) *Attorney, Agent, or Firm* — Posz Law Group, PLC

(57) ABSTRACT

An air-conditioning apparatus that can prevent freezing of a heat transfer medium even when using a non-azeotropic refrigerant mixture. The air-conditioning apparatus is designed such that when a heat exchanger serves as a cooler that cools a heat transfer medium, it controls a heat medium passage reversing device. This is so that, when a heat transfer medium flowing through a heat medium flow passage will not be frozen, a refrigerant flowing through a refrigerant flow passage and the heat transfer medium flowing through the heat medium flow passage are in counter flow. It is also to control the heat medium passage reversing device so that, when there is a possibility of freezing the heat transfer medium flowing through the heat medium flow passage, the refrigerant flowing through the refrigerant flow passage and the heat transfer medium flowing through the heat medium flow passage are in parallel flow.

17 Claims, 15 Drawing Sheets

(51) Int. Cl.

| | |
|---|---|
| ***F25B 1/00*** | (2006.01) |
| ***F25B 13/00*** | (2006.01) |
| ***F25B 49/02*** | (2006.01) |
| ***F25B 25/00*** | (2006.01) |
| ***F25B 49/00*** | (2006.01) |
| *F24F 11/00* | (2006.01) |

(52) U.S. Cl.
CPC ..... *F25B 49/005* (2013.01); *F25B 49/02* (2013.01); *F24F 2011/0087* (2013.01); *F25B 2313/0231* (2013.01); *F25B 2313/0233* (2013.01); *F25B 2313/02742* (2013.01)

(56) References Cited

U.S. PATENT DOCUMENTS

| | | | | |
|---|---|---|---|---|
| 9,494,363 | B2 * | 11/2016 | Yamashita | F25B 13/00 |
| 9,506,674 | B2 * | 11/2016 | Morimoto | F25B 13/00 |
| 2001/0037654 | A1 * | 11/2001 | Kobayashi | F25B 9/006 62/222 |
| 2005/0252226 | A1 * | 11/2005 | Seefeldt | F24D 3/12 62/238.7 |
| 2011/0113802 | A1 * | 5/2011 | Wakamoto | F24F 3/06 62/196.1 |
| 2011/0146339 | A1 * | 6/2011 | Yamashita | F24F 3/06 62/513 |
| 2011/0185756 | A1 * | 8/2011 | Yamashita | F24F 3/06 62/171 |
| 2012/0291472 | A1 * | 11/2012 | Morimoto | F24F 1/26 62/324.6 |
| 2012/0304675 | A1 * | 12/2012 | Motomura | F24F 3/06 62/156 |
| 2013/0031921 | A1 * | 2/2013 | Hamada | F24F 13/222 62/155 |
| 2013/0031932 | A1 * | 2/2013 | Hamada | F28D 1/0478 62/498 |
| 2013/0167572 | A1 * | 7/2013 | Yamashita | F25B 13/00 62/190 |
| 2013/0219937 | A1 * | 8/2013 | Motomura | F25B 13/00 62/126 |
| 2013/0219940 | A1 * | 8/2013 | Yamashita | F25B 1/00 62/160 |
| 2013/0227976 | A1 * | 9/2013 | Yamashita | F24F 3/065 62/126 |
| 2013/0233008 | A1 * | 9/2013 | Yamashita | F25B 1/10 62/196.1 |
| 2013/0239602 | A1 * | 9/2013 | Yamashita | F25B 1/10 62/160 |
| 2013/0333862 | A1 * | 12/2013 | Yamashita | F25B 1/10 165/63 |
| 2014/0026605 | A1 * | 1/2014 | Ishimura | F25B 1/00 62/222 |
| 2014/0083123 | A1 * | 3/2014 | Yamashita | F25B 13/00 62/222 |
| 2014/0124158 | A1 * | 5/2014 | Yamashita | F25D 11/006 165/10 |
| 2014/0137589 | A1 * | 5/2014 | Motomura | F25B 13/00 62/238.7 |
| 2014/0165635 | A1 * | 6/2014 | Yamashita | F25B 13/00 62/160 |
| 2014/0182320 | A1 * | 7/2014 | Hatomura | F25B 13/00 62/278 |
| 2014/0183957 | A1 * | 7/2014 | Duchesneau | F01K 13/006 307/64 |
| 2014/0223940 | A1 * | 8/2014 | Morimoto | F25B 49/027 62/183 |
| 2014/0245766 | A1 * | 9/2014 | Wakamoto | F24F 11/0086 62/151 |
| 2014/0318163 | A1 * | 10/2014 | Takayama | F25B 49/00 62/196.1 |
| 2015/0121934 | A1 * | 5/2015 | Yamaguchi | F24F 1/06 62/275 |
| 2015/0159897 | A1 * | 6/2015 | Yamashita | F24F 3/06 62/126 |
| 2015/0219351 | A1 * | 8/2015 | Yamashita | F24F 3/06 165/218 |
| 2015/0285545 | A1 * | 10/2015 | Yamashita | F25B 7/00 62/196.1 |
| 2015/0330674 | A1 * | 11/2015 | Yamashita | F25B 13/00 62/160 |

FOREIGN PATENT DOCUMENTS

| | | | |
|---|---|---|---|
| JP | 2000-320917 | A | 11/2000 |
| JP | 2001-065928 | A | 3/2001 |
| JP | 2002-048359 | A | 2/2002 |
| JP | 2002-364936 | A | 12/2002 |
| JP | 2003-343936 | A | 12/2003 |
| JP | 2004-286407 | A | 10/2004 |
| JP | 2008-051427 | A | 3/2008 |
| WO | 2010/049998 | A1 | 5/2010 |
| WO | 20101050003 | A1 | 5/2010 |
| WO | 20101131335 | A1 | 11/2010 |

OTHER PUBLICATIONS

Office Action mailed Mar. 18, 2014 issued in corresponding JP patent application No. 2012-554481 (and English translation).
Extended European Search Report dated Mar. 30, 2017 issued in corresponding EP patent application No. 11857036.5.

* cited by examiner

AIR-CONDITIONING APPARATUS FOR PREVENTING THE FREEZING OF NON-AZEOTROPIC REFRIGERANT

CROSS REFERENCE TO RELATED APPLICATION

This application is a U.S. national stage application of International Application No. PCT/JP2011/000447 filed on Jan. 27, 2011.

TECHNICAL FIELD

The present invention relates to an air-conditioning apparatus applicable to, for example, a multi-air-conditioning apparatus for a building or the like.

BACKGROUND ART

An example of a conventional air-conditioning apparatus such as a multi-air-conditioning apparatus for buildings is an air-conditioning apparatus that causes a refrigerant to circulate from an outdoor unit to a heat medium relay unit (relay unit) and that causes a heat medium such as water to circulate from the heat medium relay unit to indoor units, so as to reduce the power used to convey the heat medium while causing the heat medium to circulate to the indoor units (for example, Patent Literature 1).

Further, an example of a conventional air-conditioning apparatus that uses a non-azeotropic refrigerant mixture is a chiller air-conditioning apparatus that causes a non-azeotropic refrigerant mixture and a heat medium to flow through a heat exchanger related to heat medium (refrigerant/heat medium heat exchanger) in opposing directions (that is, the flows are in counter flow) to improve heat exchange efficiency (for example, Patent Literature 2).

Further, an example of a conventional air-conditioning apparatus that uses a non-azeotropic refrigerant mixture is a chiller air-conditioning apparatus that causes a non-azeotropic refrigerant mixture and a heat medium to flow through a heat exchanger related to heat medium serving as an evaporator of a refrigerant circuit in parallel in the same direction (that is, the flows are in parallel flow) to prevent freezing of the heat medium while keeping the temperature of the heat medium at the inlet of the heat exchanger related to heat medium constant (for example, Patent Literature 3).

Further, an example of a conventional air-conditioning apparatus that uses a non-azeotropic refrigerant mixture is an air-conditioning apparatus of a heat pump based cold/hot water pumping type configured such that a four-way valve is switched to reverse a refrigerant flow passage of a heat exchanger related to heat medium so that a refrigerant and a heat medium are in parallel flow in the heat exchanger related to heat medium during a cooling operation and a refrigerant and a heat medium are in counter flow in the heat exchanger related to heat medium during a heating operation (for example, Patent Literature 4).

CITATION LIST

Patent Literature

Patent Literature 1: WO10/049,998 pamphlet (paragraphs [0007] and [0008], FIG. 1)

Patent Literature 2: Japanese Unexamined Patent Application Publication No. 2002-364936 (abstract, FIGS. 1 to 3)

Patent Literature 3: Japanese Unexamined Patent Application Publication No. 2004-286407 (abstract, FIG. 1)

Patent Literature 4: Japanese Unexamined Patent Application Publication No. 2000-320917 (abstract, FIG. 1)

SUMMARY OF INVENTION

Technical Problem

The conventional air-conditioning apparatus described in Patent Literature 1 is configured to cause a refrigerant to circulate between an outdoor unit and a heat medium relay unit and to cause a heat medium such as water to circulate between the heat medium relay unit and indoor units, such that the heat medium relay unit causes heat exchange between the refrigerant and the heat medium such as water. This reduces the power used to convey the heat medium and therefore improves the operation efficiency of the air-conditioning apparatus. However, since the conventional air-conditioning apparatus described in Patent Literature 1 is not presumably designed to use a non-azeotropic refrigerant mixture having a temperature glide between the saturated liquid temperature and the saturated gas temperature at the same pressure, the use of a non-azeotropic refrigerant mixture causes a problem of it not necessarily being possible to provide efficient operation. Further, the conventional air-conditioning apparatus described in Patent Literature 1 cools the heat medium by causing heat exchange between the refrigerant and the heat medium in counter flow. For this reason, in the case of using a non-azeotropic refrigerant mixture having a temperature glide in the heat exchange process, a low-temperature refrigerant undergoes heat exchange with a low-temperature heat medium, and a problem occurs in that the heat medium is prone to freezing if the temperature of the heat medium is low.

The conventional air-conditioning apparatus described in Patent Literature 2 uses a non-azeotropic refrigerant mixture having a temperature glide in the heat exchange process, such that a refrigerant and a heat medium such as water, which flow through a heat exchanger related to heat medium, are always in counter flow. This allows the temperature glide of the refrigerant and the temperature glide of the heat medium to be in the same direction to improve the heat exchange efficiency of the heat exchanger related to heat medium. In the conventional air-conditioning apparatus described in Patent Literature 2, however, since a low-temperature refrigerant undergoes heat exchange with a low-temperature heat medium, a problem occurs in that the heat medium is prone to freezing if the temperature of the heat medium is low.

The conventional air-conditioning apparatus described in Patent Literature 3 uses a non-azeotropic refrigerant mixture having a temperature glide in the heat exchange process, such that a refrigerant and a heat medium such as water, which flow through a heat exchanger related to heat medium, are in parallel flow. For this reason, the conventional air-conditioning apparatus described in Patent Literature 3 can prevent freezing of the heat medium but has a problem in that the heat exchange efficiency of the heat exchanger related to heat medium is not so high.

The conventional air-conditioning apparatus described in Patent Literature 4 uses a non-azeotropic refrigerant mixture having a temperature glide in the heat exchange process, such that the passages of a heat exchanger related to heat medium are switched between counter flow and parallel flow by reversing the refrigerant passage. In the conventional air-conditioning apparatus described in Patent Literature 4, however, since the passages of the heat exchanger related to heat medium are always in parallel flow during the cooling operation, the passages of the heat exchanger related to heat medium are not allowed to be in counter flow even if the temperature of the heat medium is high. Thus, a problem occurs in that the heat exchange efficiency of the heat exchanger related to heat medium may not be improved.

The present invention has been made in order to overcome the foregoing problems, and an object thereof is to provide an air-conditioning apparatus with high energy efficiency and capable of preventing freezing of a heat medium even in the case of using a non-azeotropic refrigerant mixture having a temperature glide between the saturated liquid temperature and the saturated gas temperature at the same pressure.

Solution to Problem

An air-conditioning apparatus according to the present invention includes a refrigerant circuit in which a compressor, a refrigerant passage switching device that switches a passage of a refrigerant discharged from the compressor, a first heat exchanger, a first expansion device, and a refrigerant flow passage of a second heat exchanger are connected via a refrigerant pipe through which the refrigerant is distributed; a heat medium circuit in which a heat medium flow passage of the second heat exchanger and a heat medium sending device are connected via a heat medium pipe through which a heat medium is distributed, and to which a use side heat exchanger is connected; a heat medium passage reversing device that is disposed in the heat medium circuit and that is capable of switching a direction of the heat medium flowing through the heat medium flow passage of the second heat exchanger between a normal direction and a reverse direction; a controller that controls the heat medium passage reversing device to switch the direction of the heat medium flowing through the heat medium flow passage of the second heat exchanger; and a freezing determination unit (i.e., a freezing processor) that is disposed in the controller and that determines whether or not there is a possibility of freezing of the heat medium flowing through the heat medium flow passage of the second heat exchanger. The refrigerant flowing through the refrigerant circuit is a non-azeotropic refrigerant mixture including two or more components and having a temperature glide between a saturated gas temperature and a saturated liquid temperature at the same pressure. In a condition where the second heat exchanger serves as a cooler that cools the heat medium, the controller controls the heat medium passage reversing device so that, when the freezing determination unit determines that the heat medium flowing through the heat medium flow passage of the second heat exchanger will not be frozen, the refrigerant flowing through the refrigerant flow passage of the second heat exchanger and the heat medium flowing through the heat medium flow passage of the second heat exchanger are in counter flow, and controls the heat medium passage reversing device so that, when the freezing determination unit determines that there is a possibility of freezing of the heat medium flowing through the heat medium flow passage of the second heat exchanger, the refrigerant flowing through the refrigerant flow passage of the second heat exchanger and the heat medium flowing through the heat medium flow passage of the second heat exchanger are in parallel flow.

Advantageous Effects of Invention

In an air-conditioning apparatus according to the present invention, when a second heat exchanger serves as a cooler that cools a heat medium, if a freezing determination unit determines that a heat medium flowing through a heat medium flow passage of the second heat exchanger will not be frozen, a refrigerant flowing through a refrigerant flow passage of the second heat exchanger and the heat medium flowing through the heat medium flow passage of the second heat exchanger are in counter flow. Thus, the air-conditioning apparatus according to the present invention can improve the heat exchange efficiency of the second heat exchanger. In the air-conditioning apparatus according to the present invention, furthermore, when the second heat exchanger serves as a cooler that cools the heat medium, if the freezing determination unit determines that there is a possibility of freezing of the heat medium flowing through the heat medium flow passage of the second heat exchanger, the refrigerant flowing through the refrigerant flow passage of the second heat exchanger and the heat medium flowing through the heat medium flow passage of the second heat exchanger are in parallel flow. Thus, the air-conditioning apparatus according to the present invention can cause a high-temperature heat medium to undergo heat exchange with a low-temperature refrigerant and a low-temperature heat medium to undergo heat exchange with a high-temperature heat medium in the second heat exchanger. This can prevent freezing of the heat medium in the second heat exchanger.

In this manner, since a passage in the second heat exchanger is switched in accordance with the state of the heat medium flowing through the second heat exchanger, the air-conditioning apparatus according to the present invention can achieve consistent energy efficiency improvement and freezing prevention.

DESCRIPTION OF EMBODIMENTS

Embodiment

Figure 1:
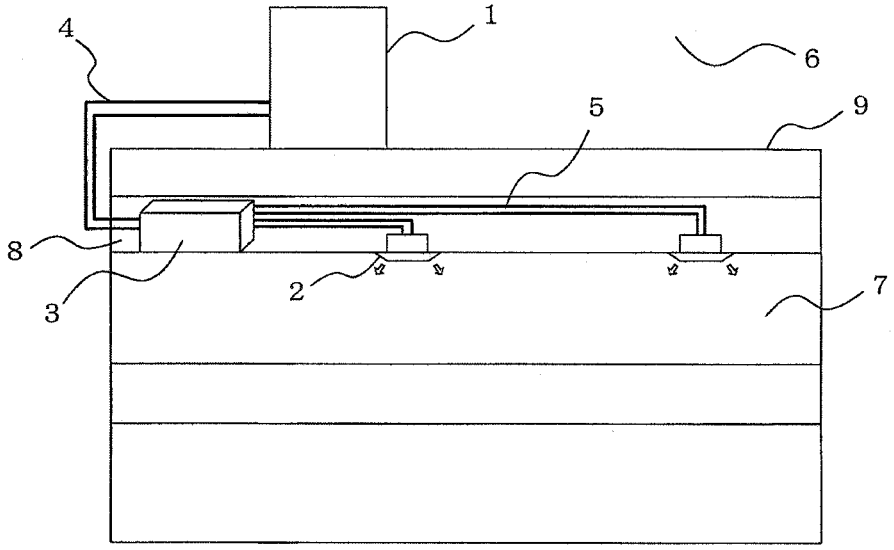
FIG. 1 is a schematic diagram illustrating an example installation of an air-conditioning apparatus according to Embodiment of the present invention.

Embodiment of the present invention will be described with reference to the drawings. FIG. 1 is a schematic diagram illustrating an example installation of an air-conditioning apparatus according to Embodiment of the present invention. An example installation of the air-conditioning apparatus will be described with reference to FIG. 1. The illustrated air-conditioning apparatus uses a refrigerant circuit A that causes a refrigerant (heat source side refrigerant) to circulate and a heat medium circuit B that causes a heat medium to circulate, thereby being capable of freely selecting a cooling mode or a heating mode for each indoor unit as its operation mode. In the following drawings, including FIG. 1, the dimensional relationships between constituent members may be different from the actual ones.

In FIG. 1, the air-conditioning apparatus according to Embodiment includes a single outdoor unit 1, which is a heat source unit, a plurality of indoor units 2, and a heat medium relay unit 3 interposed between the outdoor unit 1 and the indoor units 2. The heat medium relay unit 3 is designed to cause heat exchange between a refrigerant and a heat medium. The outdoor unit 1 and the heat medium relay unit 3 are connected via refrigerant pipes 4 through which the refrigerant passes. The heat medium relay unit 3 and the indoor units 2 are connected via pipes (heat medium pipes) 5 through which the heat medium passes. Cooling energy or heating energy generated in the outdoor unit 1 is delivered to the indoor units 2 through the heat medium relay unit 3.

The outdoor unit 1 is generally installed in an outdoor space 6, which is an outside space (for example, a roof) of a structure 9 such as a building, and is designed to supply cooling energy or heating energy to the indoor units 2 through the heat medium relay unit 3. The indoor units 2 are installed at positions so as to be able to supply cooling air or heating air to an indoor space 7, which is an inside space (for example, a living room) of the structure 9, and are designed to supply the cooling air or heating air to the indoor space 7, which is an air-conditioned space. The heat medium relay unit 3 includes a housing separated from the outdoor unit 1 and the indoor units 2 such that the heat medium relay unit 3 can be installed at a position different from the outdoor space 6 and the indoor space 7. The heat medium relay unit 3 is connected to the outdoor unit 1 and the indoor units 2 via the refrigerant pipes 4 and the pipes 5, respectively, to transfer the cooling energy or heating energy supplied from the outdoor unit 1 to the indoor units 2.

As illustrated in FIG. 1, in the air-conditioning apparatus according to Embodiment, the outdoor unit 1 and the heat medium relay unit 3 are connected using two refrigerant pipes 4, and the heat medium relay unit 3 and each of the indoor units 2 are connected using two pipes 5. In this manner, the connection of each of the units (the outdoor unit 1, the indoor units 2, and the heat medium relay unit 3) using two pipes (the refrigerant pipes 4, the pipes 5) facilitates construction of the air-conditioning apparatus according to Embodiment.

In FIG. 1, by way of example, the heat medium relay unit 3 is located in a space which is inside the structure 9 but is a space different from the indoor space 7, such as a space above a ceiling (hereinafter referred to simply as the space 8). The heat medium relay unit 3 may also be located in any other place such as a common space where an elevator and the like are installed. In FIG. 1, furthermore, the indoor units 2 are of a ceiling cassette type, by way of example, but are not limited thereto, and may be of any type capable of blowing out heating air or cooling air to the indoor space 7 directly or through ducts or the like, such as a ceiling-concealed type or a ceiling-suspended type.

In FIG. 1, by way of example, the outdoor unit 1 is located in the outdoor space 6, but is not limited thereto. For example, the outdoor unit 1 may be located in an enclosed space such as a machine room with a ventilation opening, may be located inside the structure 9 so long as waste heat can be exhausted to the outside of the structure 9 through exhaust ducts, or may also be located inside the structure 9 when the used outdoor unit 1 is of a water-cooled type. Even if the outdoor unit 1 is installed in such a place, no particular problem will occur.

Further, the heat medium relay unit 3 can also be installed in the vicinity of the outdoor unit 1. It should be noted that if the distance from the heat medium relay unit 3 to the indoor units 2 is excessively long, a considerably high power is required to convey the heat medium, resulting in the effect of energy saving being impaired. Furthermore, the numbers of connected outdoor units 1, indoor units 2, and heat medium relay units 3 are not limited to those illustrated in FIG. 1, and may be determined in accordance with the structure 9 where the air-conditioning apparatus according to Embodiment is installed.

Figure 2:
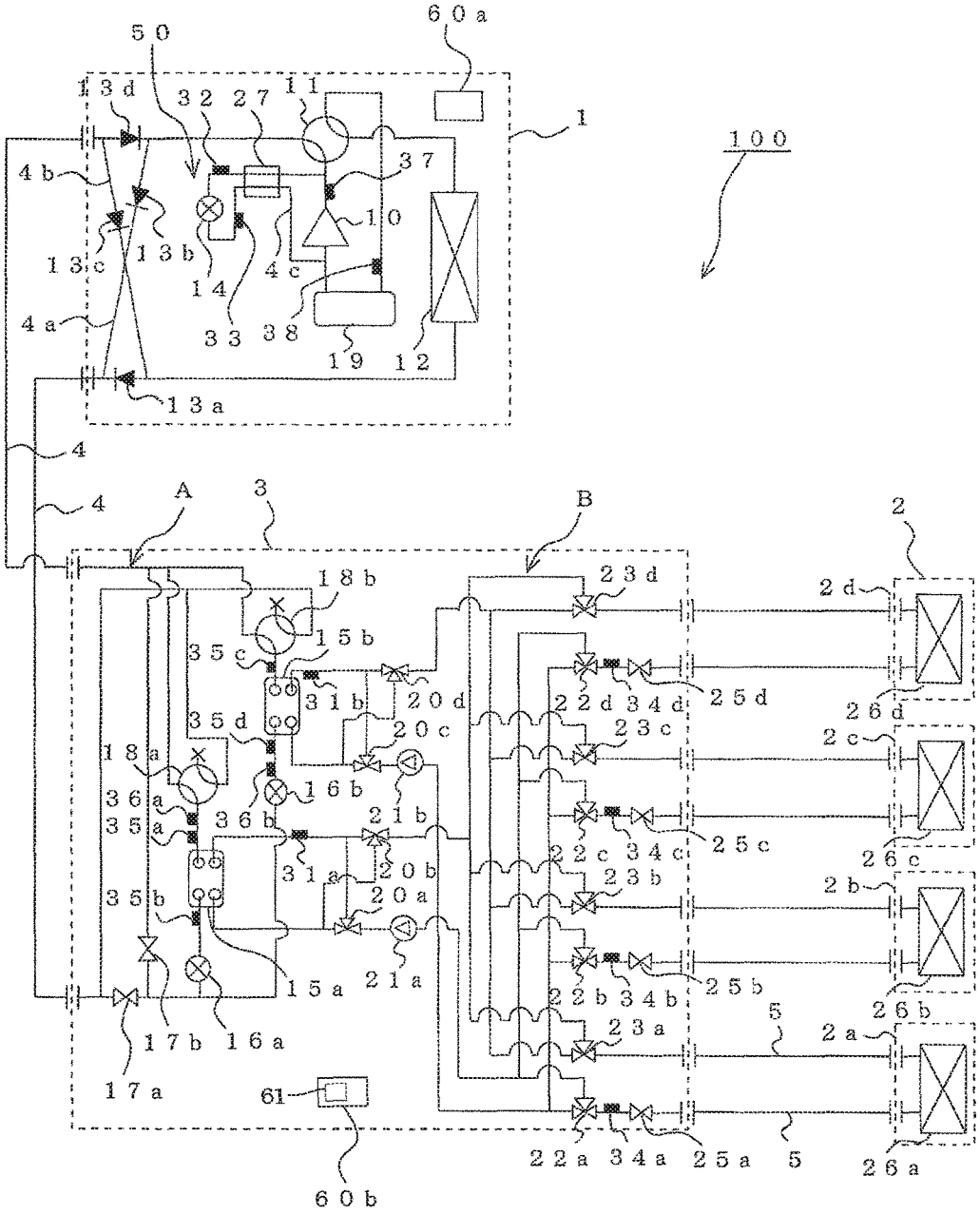
FIG. 2 is a schematic circuit configuration diagram illustrating an example circuit configuration of the air-conditioning apparatus according to Embodiment of the present invention.

FIG. 2 is a schematic circuit configuration diagram illustrating an example circuit configuration of the air-conditioning apparatus (hereinafter referred to as the air-conditioning apparatus 100) according to Embodiment of the present invention. The detailed configuration of the air-conditioning apparatus 100 will be described with reference to FIG. 2. As illustrated in FIG. 2, the outdoor unit 1 and the heat medium relay unit 3 are connected via the refrigerant pipes 4 through heat exchangers related to heat medium 15*a* and 15*b* included in the heat medium relay unit 3. The heat medium relay unit 3 and the indoor units 2 are also connected via the pipes 5 through the heat exchangers related to heat medium 15*a* and 15*b*.

[Outdoor Unit 1]

The outdoor unit 1 has a compressor 10, a first refrigerant passage switching device 11, such as a four-way valve, a heat source side heat exchanger 12, and an accumulator 19, which are connected in series via the refrigerant pipes 4. Here, the heat source side heat exchanger 12 corresponds to a first heat exchanger in the present invention.

The outdoor unit 1 further includes a first connecting pipe 4*a*, a second connecting pipe 4*b*, a check valve 13*a*, a check valve 13*b*, a check valve 13*c*, and a check valve 13*d*. The provision of the first connecting pipe 4*a*, the second connecting pipe 4*b*, the check valve 13*a*, the check valve 13*b*, the check valve 13*c*, and the check valve 13*d* allows the refrigerant to flow into the heat medium relay unit 3 in a constant direction regardless of the operation requested by the indoor units 2.

The outdoor unit 1 further includes a high-low pressure bypass pipe 4*c* that connects a discharge-side passage and suction-side passage of the compressor 10, an expansion device 14 disposed in the high-low pressure bypass pipe 4*c*, a refrigerant-refrigerant heat exchanger 27 that causes heat exchange between pipes located before and after the expansion device 14 (in other words, heat exchange between the refrigerant flowing through the high-low pressure bypass pipe 4*c* on the inlet side of the expansion device 14 and the refrigerant flowing through the high-low pressure bypass pipe 4*c* on the outlet side of the expansion device 14), a high-pressure side refrigerant temperature detection device 32 and a low-pressure side refrigerant temperature detection device 33 disposed on the inlet side and outlet side of the expansion device 14, respectively, a high-pressure side pressure detection device 37 capable of detecting the high-pressure side pressure of the compressor 10 (that is, the pressure of the refrigerant discharged by the compressor 10), and a low-pressure side pressure detection device 38 capable of detecting the low-pressure side pressure of the compressor 10 (that is, the pressure on the low-pressure side of the compressor 10). The high-pressure side pressure detection device 37 and the low-pressure side pressure detection device 38, which are of a type such as a strain gauge type or a semiconductor type, are used, and the high-pressure side refrigerant temperature detection device 32 and the low-pressure side refrigerant temperature detection device 33, which are of a type such as a thermistor type, are used. Here, the expansion device 14 corresponds to a second expansion device in the present invention.

The compressor 10 is designed to suck in the refrigerant and compress the refrigerant into a high-temperature and high-pressure state, and may include, for example, a capacity-controllable inverter compressor or the like. The first refrigerant passage switching device 11 is designed to switch between the flow of the refrigerant in a heating operation (a heating only operation mode and a heating main operation mode) and the flow of the refrigerant in a cooling operation (a cooling only operation mode and a cooling main operation mode). The heat source side heat exchanger 12 serves as an evaporator in the heating operation, and serves as a condenser (or radiator) in the cooling operation. The heat source side heat exchanger 12 is designed to cause heat exchange between the air supplied from an air-sending device (not illustrated) such as a fan and the refrigerant, and to evaporate and gasify or condense and liquefy the refrigerant. The accumulator 19 is disposed on the suction side of the compressor 10, and is designed to store excess refrigerant.

The check valve 13*d* is disposed in the refrigerant pipe 4 between the heat medium relay unit 3 and the first refrigerant passage switching device 11, and is designed to permit the flow of the refrigerant only in a certain direction (the direction from the heat medium relay unit 3 to the outdoor unit 1). The check valve 13*a* is disposed in the refrigerant pipe 4 between the heat source side heat exchanger 12 and the heat medium relay unit 3, and is designed to permit the flow of the refrigerant only in a certain direction (the direction from the outdoor unit 1 to the heat medium relay unit 3). The check valve 13*b* is disposed in the first connecting pipe 4*a*, and is designed to distribute the refrigerant discharged from the compressor 10 to the heat medium relay unit 3 in the heating operation. The check valve 13*c* is disposed in the second connecting pipe 4*b*, and is designed to distribute the refrigerant returning from the heat medium relay unit 3 to the suction side of the compressor 10 in the heating operation.

The first connecting pipe 4*a* is designed in the outdoor unit 1 to connect the refrigerant pipe 4 between the first refrigerant passage switching device 11 and the check valve 13*d* to the refrigerant pipe 4 between the check valve 13*a* and the heat medium relay unit 3. The second connecting pipe 4*b* is designed in the outdoor unit 1 to connect the refrigerant pipe 4 between the check valve 13*d* and the heat medium relay unit 3 to the refrigerant pipe 4 between the heat source side heat exchanger 12 and the check valve 13*a*. In FIG. 2, by way of example, the first connecting pipe 4*a*, the second connecting pipe 4*b*, the check valve 13*a*, the check valve 13*b*, the check valve 13*c*, and the check valve 13*d* are provided. However, Embodiment is not limited to this example. There components may not necessarily be provided.

In the refrigerant circuit A, a refrigerant mixture containing, for example, tetrafluoropropene, which is represented by chemical formula $C_3H_2F_4$ (HFO1234yf, which is represented by $CF_3CF{=}CH_2$, HFO1234ze, which is represented by $CF_3CH{=}CHF$, or the like) and difluoromethane (R32), which is represented by chemical formula $CH_2F_2$, circulates. Because the chemical formula has a double bond, tetrafluoropropene is easily decomposed in the atmosphere, and is an environment-friendly refrigerant with a low global warming potential (GWP) (for example, a GWP of 4). However, tetrafluoropropene has a lower density than conventional refrigerants such as R410A. For this reason, in a case where tetrafluoropropene is used alone as a refrigerant, a very large compressor may be required to exert high heating capacity or cooling capacity. In a case where tetrafluoropropene is used alone as a refrigerant, furthermore, thick refrigerant pipes may be required in order to prevent an increase in pressure loss at the pipes. Thus, if tetrafluoropropene is to be used alone as a refrigerant, a high-cost air-conditioning apparatus may be required. Meanwhile, R32 is a comparatively easy-to-use refrigerant because its characteristics are close to those of conventional ones. However, R32 has a GWP of, for example, 675, which is slightly high to use it alone as a refrigerant although the GWP of R32 is smaller than the GWP (for example, 2088) of R410A, which is a conventional refrigerant.

The air-conditioning apparatus 100 according to Embodiment uses a mixture of tetrafluoropropene and R32. Accordingly, the air-conditioning apparatus 100, which has improved characteristics of the refrigerant without greatly increasing GWP and therefore is earth-friendly and efficient, can be achieved. Tetrafluoropropene and R32 may be mixed at a mixture ratio of, for example, 70% to 30% in mass % for use. However, Embodiment is not limited to this mixture ratio.

A refrigerant mixture of tetrafluoropropene and R32 is non-azeotropic refrigerant having different boiling points, where, for example, HFO1234yf, which is a tetrafluoropropene, has a boiling point of −29 degrees C. and R32 has a boiling point of −53.2 degrees C. Due to the presence of a liquid pool, such as the accumulator 19, and the like, the refrigerant circulating in the refrigerant circuit A has time-varying proportions of tetrafluoropropene and R32 (hereinafter referred to as circulation compositions).

Figure 3:
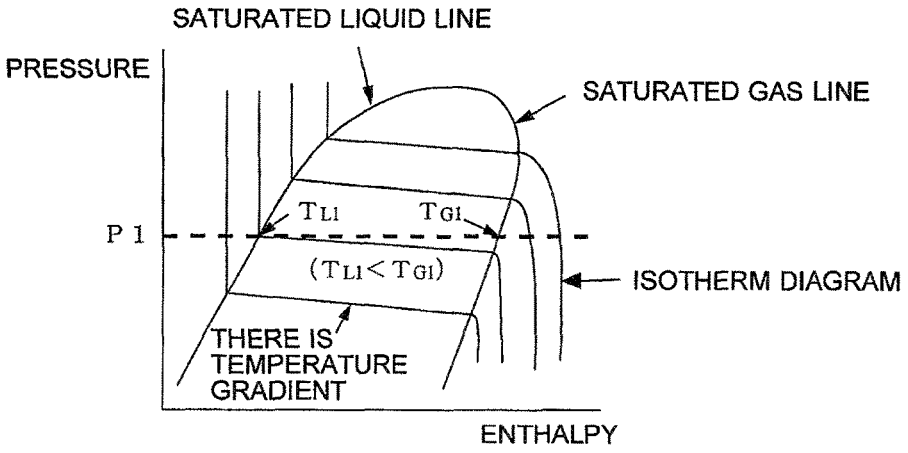
FIG. 3 is a P-h diagram (pressure-enthalpy diagram) of the air-conditioning apparatus according to Embodiment of the present invention.

Since a non-azeotropic refrigerant has mixture components (for example, HFO1234yf and R32) whose boiling points are different, the saturated liquid temperature and the saturated gas temperature at the same pressure are different. Thus, a P-h diagram as in FIG. 3 is obtained. Specifically, as illustrated in FIG. 3, a saturated liquid temperature $T_{L1}$ and a saturated gas temperature $T_{G1}$ at a pressure P1 are not equal, where the temperature $T_{G1}$ is higher than the temperature $T_{L1}$. Thus, the isotherm lines are inclined in the two-phase region in the P-h diagram. Changing the ratio of the mixture components (mixed refrigerants) of the non-azeotropic refrigerant results in a different P-h diagram, yielding a change in temperature glide. For example, if the mixture ratio of HFO1234yf to R32 is 70 mass % to 30 mass %, the temperature glide is approximately 5.0 degrees C. on the high-pressure side and is approximately 6.6 degrees C. on the low-pressure side. Further, for example, if the mixture ratio of HFO1234yf to R32 is 50 mass % to 50 mass %, the temperature glide is approximately 2.2 degrees C. on the high-pressure side and is approximately 2.8 degrees C. on the low-pressure side. That is, a function of detecting the circulation compositions of the refrigerant is required to determine a saturated liquid temperature and a saturated gas temperature at the operating pressure in the refrigeration cycle.

In the air-conditioning apparatus 100 according to Embodiment, therefore, the outdoor unit 1 is provided with a refrigerant circulation composition detection device 50. The refrigerant circulation composition detection device 50, which includes the high-low pressure bypass pipe 4*c*, the expansion device 14, the refrigerant-refrigerant heat exchanger 27, the high-pressure side refrigerant temperature detection device 32, the low-pressure side refrigerant temperature detection device 33, the high-pressure side pressure detection device 37, and the low-pressure side pressure detection device 38, is used to measure the circulation compositions of the refrigerant circulating in the refrigerant circuit A.

A circulation composition measurement method according to Embodiment will be described hereinafter with reference to FIGS. 4 to 6. A refrigerant mixture including two types of refrigerants is assumed here.

Figure 4:
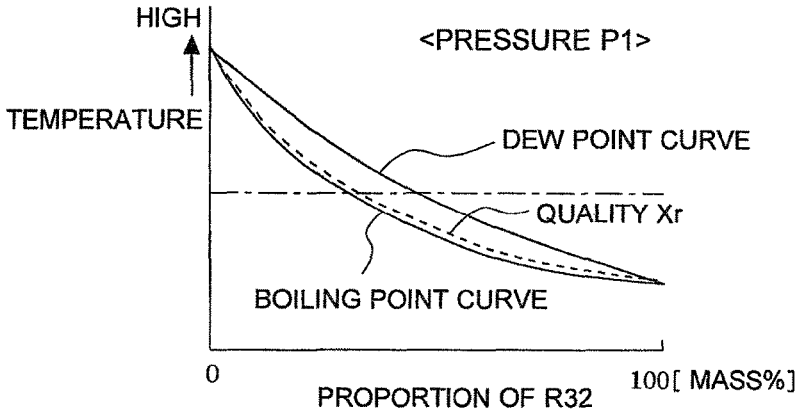
FIG. 4 is a vapor-liquid equilibrium diagram at a pressure P1 of a non-azeotropic refrigerant according to Embodiment of the present invention.

FIG. 4 is a vapor-liquid equilibrium diagram at the pressure P1 of the non-azeotropic refrigerant according to Embodiment of the present invention. FIG. 5 is a flowchart illustrating a circulation composition measurement method according to Embodiment of the present invention. FIG. 6 is a P-h diagram for the case where the non-azeotropic refrigerant according to Embodiment of the present invention is in the state of certain circulation compositions. Two solid lines illustrated in FIG. 4 indicate a dew point curve that is a saturated gas line when a gaseous refrigerant is condensed and liquefied, and a boiling point curve that is a saturated liquid line when a liquid refrigerant is evaporated and gasified. The procedure for circulation composition measurement illustrated in FIG. 5 is performed by a controller 60 included in the air-conditioning apparatus 100.

Figure 5:
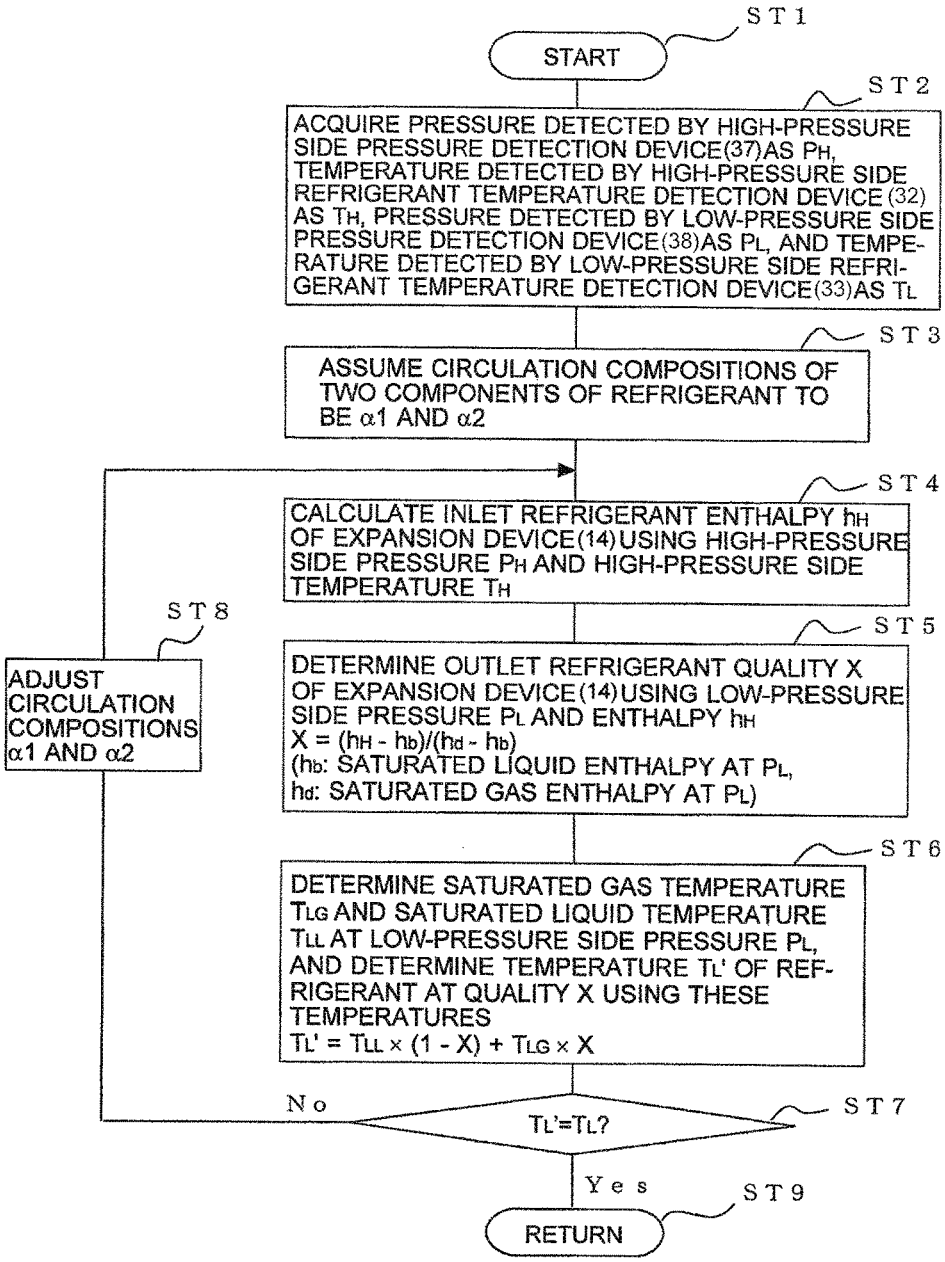
FIG. 5 is a flowchart illustrating a circulation composition measurement method according to Embodiment of the present invention.

As illustrated in FIG. 5, when the measurement of circulation compositions starts (ST1), the controller 60 acquires a pressure $P_H$ detected by the high-pressure side pressure detection device 37, a temperature $T_H$ detected by the high-pressure side refrigerant temperature detection device 32, a pressure $P_L$ detected by the low-pressure side pressure detection device 38, and a temperature $T_L$ detected by the low-pressure side refrigerant temperature detection device 33 (ST2). Then, the controller 60 assumes the circulation compositions of the two components of the refrigerant circulating in the refrigerant circuit A to be $\alpha$1 and $\alpha$2 (ST3).

Once the circulation compositions of the refrigerant are determined, the enthalpy of the refrigerant can be calculated from the P-h diagram (FIG. 6) of the circulation compositions, the pressure of the refrigerant, and the temperature of the refrigerant. Then, the controller 60 determines the enthalpy $h_H$ of the refrigerant on the inlet side of the expansion device 14 using the P-h diagram (or data (such as a table and a calculation formula) for determining the P-h diagram) when the circulation compositions of the refrigerant circulating in the refrigerant circuit A are $\alpha$1 and $\alpha$2, the pressure $P_H$ detected by the high-pressure side pressure detection device 37, and the temperature $T_H$ detected by the high-pressure side refrigerant temperature detection device 32 (ST4) (point C in FIG. 6). When the refrigerant is expanded by the expansion device 14, the enthalpy of the refrigerant does not change. This enables the controller 60 to determine a quality X of the two-phase refrigerant on the outlet side of the expansion device 14 using the pressure $P_L$ detected by the low-pressure side pressure detection device 38 and the calculated enthalpy $h_H$ (ST5) (point D in FIG. 6). Note that the controller 60 determines a quality X of the two-phase refrigerant on the outlet side of the expansion device 14 in accordance with Formula (1) given below.

$$X=(h_H-h_b)/(h_d-h_b) \quad (1)$$

Here, $h_b$ denotes the saturated liquid enthalpy at the pressure $P_L$ detected by the low-pressure side pressure detection device 38, and $h_d$ denotes the saturated gas enthalpy at the pressure $P_L$ detected by the low-pressure side pressure detection device 38.

In ST6, the controller 60 determines a saturated gas temperature $T_{LG}$ and a saturated liquid temperature $T_{LL}$ at the pressure $P_L$ detected by the low-pressure side pressure detection device 38. The saturated gas temperature $T_{LG}$ and the saturated liquid temperature $T_{LL}$ can be determined on the basis of, for example, the P-h diagram illustrated in FIG. 6 (or data (such as a table and a calculation formula) for determining the P-h diagram) obtained when the circulation compositions are $\alpha$1 and $\alpha$2 and the vapor-liquid equilibrium diagram illustrated in FIG. 4 (or data (such as a table and a calculation formula) for determining the vapor-liquid equilibrium diagram) obtained when the circulation compositions are $\alpha$1 and $\alpha$2. Further, the controller 60 determines the temperature $T_L'$ of the refrigerant at the quality X using the saturated gas temperature $T_{LG}$ and the saturated liquid temperature $T_{LL}$ at the pressure $P_L$ detected by the low-pressure side pressure detection device 38 in accordance with Formula (2) given below.

$$T_L' = T_{LL} \times (1-X) + T_{LG} \times X \quad (2)$$

In ST7, the controller 60 determines whether or not $T_L'$ is substantially equal to the temperature $T_L$ detected by the low-pressure side refrigerant temperature detection device 33 (that is, the controller 60 determines whether or not the difference between them is within a certain range). If the difference between $T_L'$ and $T_L$ is greater than the certain range, the controller 60 adjust the assumed circulation compositions $\alpha$1 and $\alpha$2 of the two components of the refrigerant (ST8), and repeats the process from ST4. If $T_L'$ and $T_L$ are substantially equal, the controller 60 regards circulation compositions as being successfully determined, and then the process ends (ST9).

Accordingly, the circulation compositions of a two-component non-azeotropic refrigerant mixture can be determined by the process described above.

In Embodiment, the enthalpy $h_H$ is calculated using the pressure $P_H$ detected by the high-pressure side pressure detection device 37. If the isotherm lines are substantially vertical in the subcooled-liquid region in FIG. 6 (P-h diagram), the enthalpy $h_H$ can be determined only using the temperature $T_H$ detected by the high-pressure side refrigerant temperature detection device 32 without installation of the high-pressure side pressure detection device 37. For example, for a refrigerant mixture of tetrafluoropropene (for example, HFO1234yf) and R32 and the like, the isotherm lines are substantially vertical in the subcooled-liquid region in the P-h diagram. Therefore, the high-pressure side pressure detection device 37 is not necessarily required when a refrigerant mixture of tetrafluoropropene (for example, HFO1234yf) and R32 or the like is used.

Even in a three-component non-azeotropic refrigerant mixture, a correlation is established between the proportions of two components among the three components. Thus, once the circulation compositions of two components are assumed, the circulation composition of the other component can be determined, and the circulation compositions can therefore be determined using a similar processing method. In Embodiment, the description has been given taking an example of a two-component refrigerant mixture containing tetrafluoropropene, which is represented by chemical formula $C_3H_2F_4$ (HFO1234yf, which is represented by $CF_3CF{=}CH_2$, HFO1234ze, which is represented by $CF_3CH{=}CHF$, or the like) and difluoromethane (R32), which is represented by chemical formula $CH_2F_2$, but Embodiment is not limited thereto. Any other two-component refrigerant mixture having different boiling points or a three-component refrigerant mixture including an additional component may be used, and the circulation compositions can be determined using a similar method.

Further, the expansion device 14 may be an electronic expansion valve whose opening degree is variable, or may be a device with a fixed aperture, such as a capillary tube. Further, the refrigerant-refrigerant heat exchanger 27 may be a double-pipe heat exchanger, but is not limited thereto. A plate-type heat exchanger, a micro-channel heat exchanger, or the like may be used, or any type that causes heat exchange between a high-pressure refrigerant and a low-pressure refrigerant may be used. In the illustration of FIG. 2, the low-pressure side pressure detection device 38 is located in the passage between the accumulator 19 and the refrigerant passage switching device 11. The position at which the low-pressure side pressure detection device 38 is disposed is not limited to the illustrated one. The low-pressure side pressure detection device 38 may be disposed at any position where the low-pressure side pressure of the compressor 10 can be measured, such as in the passage between the compressor 10 and the accumulator 19. Further, the position at which the high-pressure side pressure detection device 37 is disposed is not limited to the position illustrated in FIG. 2. The high-pressure side pressure detection device 37 may be disposed at any position where the high-pressure pressure side of the compressor 10 can be measured.

As described above, once the circulation compositions of the refrigerant circulating in the refrigerant circuit A can be measured, a saturated liquid temperature and a saturated gas temperature at a certain pressure can be calculated. For example, if the pressure of the refrigerant flowing into the heat exchanger is P1, the saturated liquid temperature and the saturated gas temperature at that pressure can be calculated using FIG. 4. Then, the saturated liquid temperature and the saturated gas temperature may be used, and, for example, an average temperature of them may be determined. The average temperature may be used as the saturated temperature at that pressure, and may be used to control the compressor and the expansion devices. Since the thermal conductivity of the refrigerant differs depending on quality, a weighted average temperature of a saturated liquid temperature and a saturated gas temperature which are weighted may be used as the saturated temperature.

On the low-pressure side (the evaporation side), it is possible to determine a saturated liquid temperature, a saturated gas temperature, and so forth without measuring a pressure. More specifically, the temperature of the two-phase refrigerant at the inlet of the evaporator is measured, and is assumed to be the saturated liquid temperature or the temperature of the two-phase refrigerant at a set quality. An inverse calculation of a relational expression (formula into which FIG. 4 is transformed) for determining a saturated liquid temperature and a saturated gas temperature using circulation compositions and a pressure can determine the pressure, the saturated gas temperature, and so forth. Accordingly, a pressure detection device is not necessarily required on the low-pressure side (evaporation side). Since this calculation method requires that a measured temperature be assumed to be a saturated liquid temperature or a quality be set from a measured temperature, a saturated liquid temperature and a saturated gas temperature can be determined with higher accuracy by using a pressure detection device.

While the description has been made here taking an example where the refrigerant is a refrigerant mixture of HFO1234yf (tetrafluoropropene) and R32, Embodiment is not limited thereto. A refrigerant mixture of a refrigerant other tetrafluoropropene, such as HFO1234ze, and R32 or any non-azeotropic refrigerant mixture having a temperature glide between a saturated gas temperature and a saturated liquid temperature at the same pressure, such as R407C, may be used, and similar advantages are achieved.

[Indoor Unit 2]

Each of the indoor units 2 includes a use side heat exchanger 26. The use side heat exchangers 26 are designed to be connected to heat medium flow control devices 25 and first heat medium passage switching devices 23 of the heat medium relay unit 3 via the pipes 5. The use side heat exchangers 26 are designed to cause heat exchange between the air supplied from air-sending devices (not illustrated) such as fans and the heat medium to generate heating air or cooling air to be supplied to the indoor space 7.

In the illustration of FIG. 2, by way of example, four indoor units 2 are connected to the heat medium relay unit 3, and are illustrated as an indoor unit 2*a*, an indoor unit 2*b*, an indoor unit 2*c*, and an indoor unit 2*d* in this order from bottom to top of the drawing. In correspondence with the indoor units 2*a* to 2*d*, the use side heat exchangers 26 are also illustrated as a use side heat exchanger 26*a*, a use side heat exchanger 26*b*, a use side heat exchanger 26*c*, and a use side heat exchanger 26*d* in this order from bottom to top of the drawing. As in FIG. 1, the number of connected indoor units 2 is not limited to four, which is illustrated in FIG. 2.

[Heat Medium Relay Unit 3]

The heat medium relay unit 3 has the two heat exchangers related to heat medium 15, two expansion devices 16, two opening and closing devices 17, two second refrigerant passage switching devices 18, two pumps 21 (heat medium sending devices), four second heat medium passage switching devices 22, four heat medium passage reversing devices 20, the four first heat medium passage switching devices 23, and the four heat medium flow control devices 25. Here, the heat exchangers related to heat medium 15 correspond to a second heat exchanger in the present invention, the expansion devices 16 correspond to a first expansion device in the present invention, the first heat medium passage switching devices 23 correspond to a first heat medium passage switching device in the present invention, and the second heat medium passage switching devices 22 correspond to a second heat medium passage switching device in the present invention.

Each of the two heat exchangers related to heat medium 15 (the heat exchanger related to heat medium 15*a* and the heat exchanger related to heat medium 15*b*) serves as a condenser (radiator) or an evaporator, and is designed to cause heat exchange between the refrigerant and the heat medium to transfer the cooling energy or heating energy generated by the outdoor unit 1 and stored in the refrigerant to the heat medium. In other words, each of the two heat exchangers related to heat medium 15 (the heat exchanger related to heat medium 15*a* and the heat exchanger related to heat medium 15*b*) is designed to serve as a cooler for cooling the heat medium or a heater for heating the heat medium. The heat exchanger related to heat medium 15*a* is disposed between an expansion device 16*a* and a second refrigerant passage switching device 18*a* in the refrigerant circuit A, and is designed to serve to cool the heat medium in the cooling and heating mixed operation mode. The heat exchanger related to heat medium 15*b* is disposed between an expansion device 16*b* and a second refrigerant passage switching device 18*b* in the refrigerant circuit A, and is designed to serve to heat the heat medium in the cooling and heating mixed operation mode.

Each of the two expansion devices 16 (the expansion device 16*a* and the expansion device 16*b*) has functions of a pressure reducing valve and an expansion valve, and is designed to reduce the pressure of the refrigerant and expand the refrigerant. The expansion device 16*a* is disposed upstream of the heat exchanger related to heat medium 15*a* in the flow of the refrigerant in the cooling operation. The expansion device 16*b* is disposed upstream of the heat exchanger related to heat medium 15*b* in the flow of the refrigerant in the cooling operation. Each of the two expansion devices 16 may include a device whose opening degree is variably controllable, such as an electronic expansion valve.

Each of the two opening and closing devices 17 (an opening and closing device 17*a* and an opening and closing device 17*b*) includes a two-way valve or the like, and is designed to open and close the refrigerant pipe 4. The opening and closing device 17*a* is disposed in the refrigerant pipe 4 on the refrigerant inlet side. The opening and closing device 17*b* is disposed in a pipe that connects the refrigerant pipes 4 on the refrigerant inlet and outlet sides. Each of the two second refrigerant passage switching devices 18 (a second refrigerant passage switching device 18*a* and a second refrigerant passage switching device 18*b*) includes a four-way valve or the like, and is designed to switch the flow of the refrigerant in accordance with the operation mode. The second refrigerant passage switching device 18*a* is disposed downstream of the heat exchanger related to heat medium 15*a* in the flow of the refrigerant in the cooling operation. The second refrigerant passage switching device 18*b* is disposed downstream of the heat exchanger related to heat medium 15*b* in the flow of the refrigerant in the cooling only operation.

Each of the two pumps 21 (a pump 21*a* and a pump 21*b*) is designed to circulate the heat medium passing through the pipe 5. The pump 21*a* is disposed in the pipe 5 between the heat exchanger related to heat medium 15*a* and the second heat medium passage switching devices 22. The pump 21*b* is disposed in the pipe 5 between the heat exchanger related to heat medium 15*b* and the second heat medium passage switching devices 22. Each of the two pumps 21 may include, for example, a capacity-controllable pump or the like.

Each of the four heat medium passage reversing devices 20 (heat medium passage reversing devices 20*a* to 20*d*) includes a three-way valve or the like, and is designed to switch the flow direction of the heat medium in the heat exchangers related to heat medium 15*a* and 15*b*. Two of the heat medium passage reversing devices 20 are disposed for each of the heat exchangers related to heat medium 15. In the heat medium passage reversing device 20*a*, one of the three ways is connected to the pump 21*a* (heat medium sending device), another of the three ways is connected to one end of the heat exchanger related to heat medium 15*a*, and the other of the three ways is connected to a passage between the other end of the heat exchanger related to heat medium 15*a* and the heat medium passage reversing device 20*b*. In the heat medium passage reversing device 20*b*, one of the three ways is connected to the other end of the heat exchanger related to heat medium 15*a*, another of the three ways is connected to a passage between the one end of the heat exchanger related to heat medium 15*a* and the heat medium passage reversing device 20*a*, and the other of the three ways is connected to the first heat medium passage switching devices 23*a* to 23*d*. The direction of the heat medium to be distributed to the heat exchanger related to heat medium 15*a* is changed by switching between the heat medium passage reversing device 20*a* and the heat medium passage reversing device 20*b*. Here, the heat medium passage reversing device 20*a* corresponds to a first heat medium passage reversing device in the present invention, and the heat medium passage reversing device 20*b* corresponds to a second heat medium passage reversing device in the present invention.

Further, in the heat medium passage reversing device 20*c*, one of the three ways is connected to the pump 21*b* (heat medium sending device), another of the three ways is connected to one end of the heat exchanger related to heat medium 15*b*, and the other of the three ways is connected to a passage between the other end of the heat exchanger related to heat medium 15*b* and the heat medium passage reversing device 20*d*. In the heat medium passage reversing device 20*d*, one of the three ways is connected to the other end of the heat exchanger related to heat medium 15*b*, another of the three ways is connected to a passage between the one end of the heat exchanger related to heat medium 15*b* and the heat medium passage reversing device 20*c*, and the other of the three ways is connected to the first heat medium passage switching devices 23*a* to 23*d*. The direction of the heat medium to be distributed to the heat exchanger related to heat medium 15*b* is changed by switching between the heat medium passage reversing device 20*c* and the heat medium passage reversing device 20*d*. Here, the heat medium passage reversing device 20*c* corresponds to the first heat medium passage reversing device in the present invention, and the heat medium passage reversing device 20*d* corresponds to the second heat medium passage reversing device in the present invention.

Each of the four second heat medium passage switching devices 22 (second heat medium passage switching devices 22*a* to 22*d*) includes a three-way valve or the like, and is designed to switch the passage of the heat medium. The second heat medium passage switching devices 22, the number of which corresponds to the number of installed indoor units 2 (here, four), are arranged. In each of the second heat medium passage switching devices 22 one of the three ways is connected to the heat exchanger related to heat medium 15*a*, another of the three ways is connected to the heat exchanger related to heat medium 15*b*, and the other of the three ways is connected to the corresponding one of the heat medium flow control devices 25. The second heat medium passage switching devices 22 are disposed on the outlet side of the heat medium passages of the use side heat exchangers 26. The second heat medium passage switching device 22*a*, the second heat medium passage switching device 22*b*, the second heat medium passage switching device 22*c*, and the second heat medium passage switching device 22*d* are illustrated in this order from bottom to top of the drawing in correspondence with the indoor units 2.

Each of the four first heat medium passage switching devices 23 (first heat medium passage switching devices 23*a* to 23*d*) includes a three-way valve or the like, and is designed to switch the passage of the heat medium. The first heat medium passage switching devices 23, the number of which corresponds to the number of installed indoor units 2 (here, four), are arranged. In each of the first heat medium passage switching devices 23, one of the three ways is connected to the heat exchanger related to heat medium 15*a*, another of the three ways is connected to the heat exchanger related to heat medium 15*b*, and the other of the three ways is connected to the corresponding one of the use side heat exchangers 26. The first heat medium passage switching devices 23 are disposed on the inlet side of the heat medium passages of the use side heat exchangers 26. The first heat medium passage switching device 23*a*, the first heat medium passage switching device 23*b*, the first heat medium passage switching device 23*c*, and the first heat medium passage switching device 23*d* are illustrated in this order from bottom to top of the drawing in correspondence with the indoor units 2.

Each of the four heat medium flow control devices 25 (heat medium flow control devices 25*a* to 25*d*) includes a two-way valve or the like whose opening area is controllable, and is designed to control the flow rate of the flow in the pipe 5. The heat medium flow control devices 25, the number of which corresponds to the number of installed indoor units 2 (here, four), are arranged. In each of the heat medium flow control devices 25, one is connected to the corresponding one of the use side heat exchangers 26 and the other is connected to the corresponding one of the second heat medium passage switching devices 22. The heat medium flow control devices 25 are disposed on the outlet side of the heat medium passages of the use side heat exchangers 26. The heat medium flow control device 25*a*, the heat medium flow control device 25*b*, the heat medium flow control device 25*c*, and the heat medium flow control device 25*d* are illustrated in this order from bottom to top of the drawing in correspondence with the indoor units 2. The heat medium flow control devices 25 may be disposed on the inlet side of the heat medium passages of the use side heat exchangers 26.

The heat medium relay unit 3 is further provided with various detection devices (two temperature sensors 31, four temperature sensors 34, four temperature sensors 35, and two pressure sensors 36). Information (temperature information and pressure information) detected by these detection devices is sent to the controller 60, which controls the overall operation of the air-conditioning apparatus 100, to use the information for control such as the driving frequency of the compressor 10, the rotation speed of the air-sending devices (not illustrated), switching of the first refrigerant passage switching device 11, the driving frequency of the pumps 21, switching of the second refrigerant passage switching devices 18, and switching of the passage of the heat medium.

Each of the two temperature sensors 31 (a temperature sensor 31*a* and a temperature sensor 31*b*) is designed to detect the temperature of the heat medium flowing out of the corresponding one of the heat exchangers related to heat medium 15, that is, the temperature of the heat medium at the outlet of the corresponding one of the heat exchangers related to heat medium 15, and may include, for example, a thermistor or the like. The temperature sensor 31*a* is disposed in the pipe 5 on the inlet side of the pump 21*a*. The temperature sensor 31*b* is disposed in the pipe 5 on the inlet side of the pump 21*b*. Here, the temperature sensor 31*a* and the temperature sensor 31*b* correspond to a fourth temperature detection device in the present invention.

Each of the four temperature sensors 34 (temperature sensors 34*a* to 34*d*) is disposed between the corresponding one of the second heat medium passage switching devices 22 and the corresponding one of the heat medium flow control devices 25. Each of the four temperature sensors 34 is designed to detect the temperature of the heat medium flowing out of the corresponding one of the use side heat exchangers 26, and may include a thermistor or the like. The temperature sensors 34, the number of which corresponds to the number of installed indoor units 2 (here, four), are arranged. The temperature sensor 34*a*, the temperature sensor 34*b*, the temperature sensor 34*c*, and the temperature sensor 34*d* are illustrated in this order from bottom to top of the drawing in correspondence with the indoor units 2. Here, the temperature sensors 34*a* to 34*d* correspond to a third temperature detection device in the present invention.

Each of the four temperature sensors 35 (temperature sensors 35*a* to 35*d*) is disposed on the refrigerant inlet or outlet side of the corresponding one of the heat exchangers related to heat medium 15. Each of the four temperature sensors 35 is designed to detect the temperature of the refrigerant flowing into the corresponding one of the heat exchangers related to heat medium 15 or the temperature of the refrigerant flowing out of the corresponding one of the heat exchangers related to heat medium 15, and may include a thermistor or the like. The temperature sensor 35*a* is disposed between the heat exchanger related to heat medium 15*a* and the second refrigerant passage switching device 18*a*. The temperature sensor 35*b* is disposed between the heat exchanger related to heat medium 15*a* and the expansion device 16*a*. The temperature sensor 35*c* is disposed between the heat exchanger related to heat medium 15*b* and the second refrigerant passage switching device 18*b*. The temperature sensor 35*d* is disposed between the heat exchanger related to heat medium 15*b* and the expansion device 16*b*. Here, the temperature sensors 35*a* to 35*d* correspond to a first temperature detection device or a second temperature detection device in the present invention.

A pressure sensor 36*b* is disposed between, similarly to the installation position of the temperature sensor 35*d*, the heat exchanger related to heat medium 15*b* and the expansion device 16*b*, and is designed to detect the pressure of the refrigerant flowing between the heat exchanger related to heat medium 15*b* and the expansion device 16*b*. A pressure sensor 36*a* is disposed between, similarly to the installation position of the temperature sensor 35*a*, the heat exchanger related to heat medium 15*a* and the second refrigerant passage switching device 18*a*, and is designed to detect the pressure of the refrigerant flowing between the heat exchanger related to heat medium 15*a* and the second refrigerant passage switching device 18*a*.

Further, the controller 60 includes a microcomputer or the like, and is designed to control the driving frequency of the compressor 10, the rotation speed (including ON/OFF) of the air-sending devices, switching of the first refrigerant passage switching device 11, the driving of the pumps 21, the opening degree of the expansion devices 16, the opening and closing of the opening and closing devices 17, switching of the second refrigerant passage switching devices 18, switching of the heat medium passage reversing devices 20, switching of the second heat medium passage switching devices 22, switching of the first heat medium passage switching devices 23, the opening degree of the heat medium flow control devices 25, and so forth in accordance with the information detected by the various detection devices and instructions from various remote controls to execute operation modes described below. In Embodiment, the controller 60 is divided into a controller 60*a* and a controller 60*b*, such that the controller 60*a* is disposed in the outdoor unit 1 and the controller 60*b* is disposed in the heat medium relay unit 3. However, the method for installing the controller 60 is not limited to the method illustrated in Embodiment, and the controller 60 may be disposed in only either the outdoor unit 1 or the heat medium relay unit 3. Here, the controller 60*a* corresponds to a first controller in the present invention, and the controller 60*b* corresponds to a second controller in the present invention.

The pipes 5 through which the heat medium passes include pipes connected to the heat exchanger related to heat medium 15*a* and pipes connected to the heat exchanger related to heat medium 15*b*. The pipes 5 have branching pipes (here, four pipes), the number of which corresponds to the number of indoor units 2 connected to the heat medium relay unit 3. The pipes 5 are connected to the second heat medium passage switching devices 22 and the first heat medium passage switching devices 23. The second heat medium passage switching devices 22 and the first heat medium passage switching devices 23 are controlled to determine whether to cause the heat medium flowing from the heat exchanger related to heat medium 15*a* to flow into the use side heat exchangers 26 or to cause the heat medium flowing from the heat exchanger related to heat medium 15*b* to flow into the use side heat exchangers 26.

In the air-conditioning apparatus 100, the refrigerant circuit A is formed by connecting the compressor 10, the first refrigerant passage switching device 11, the heat source side heat exchanger 12, the opening and closing devices 17, the second refrigerant passage switching devices 18, the refrigerant passages of the heat exchangers related to heat medium 15, the expansion devices 16, and the accumulator 19 via the refrigerant pipes 4. Further, the heat medium circuit B is formed by connecting the heat medium passages of the heat exchangers related to heat medium 15, the pumps 21, the second heat medium passage switching devices 22, the heat medium flow control devices 25, the use side heat exchangers 26, and the first heat medium passage switching devices 23 via the pipes 5. That is, a plurality of use side heat exchangers 26 are connected in parallel to each of the heat exchangers related to heat medium 15, thereby making the heat medium circuit B have a plurality of systems.

Therefore, in the air-conditioning apparatus 100, the outdoor unit 1 and the heat medium relay unit 3 are connected through the heat exchangers related to heat medium 15*a* and 15*b* disposed in the heat medium relay unit 3, and the heat medium relay unit 3 and the indoor units 2 are also connected through the heat exchangers related to heat medium 15*a* and 15*b*. That is, the air-conditioning apparatus 100 causes heat exchange between the refrigerant circulating in the refrigerant circuit A and the heat medium circulating in the heat medium circuit B at the heat exchanger related to heat medium 15*a* and the heat exchanger related to heat medium 15*b*.

Subsequently, the operation modes of the air-conditioning apparatus 100 will be described. The air-conditioning apparatus 100 allows each of the indoor units 2 to perform a cooling operation or a heating operation in accordance with an instruction from the indoor unit 2. That is, the air-conditioning apparatus 100 is designed to allow all the indoor units 2 to perform the same operation and also allow each of the indoor units 2 to perform a different operation.

The operation modes of the air-conditioning apparatus 100 include a cooling only operation mode in which all the indoor units 2 in operation perform the cooling operation, a heating only operation mode in which all the indoor units 2 in operation perform the heating operation, a cooling main operation mode in which cooling load is larger, and a heating main operation mode in which heating load is larger. The individual operation modes will be described hereinafter along the flows of the refrigerant and the heat medium.

[First Cooling Only Operation Mode]

Figure 7:
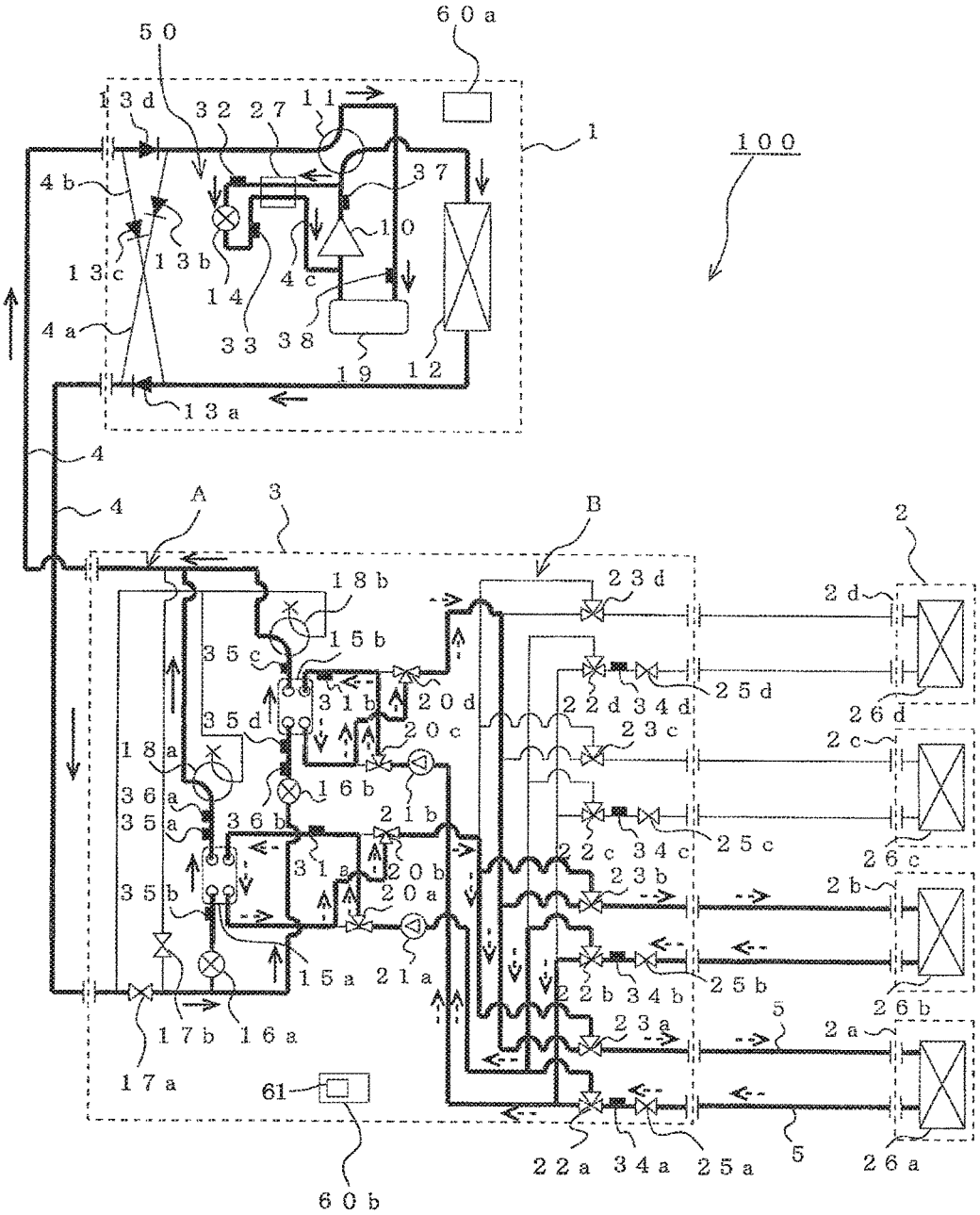
FIG. 7 is a system circuit diagram illustrating the flows of a refrigerant and a heat medium in a first cooling only operation mode of the air-conditioning apparatus according to Embodiment of the present invention.

FIG. 7 is a system circuit diagram illustrating the flows of the refrigerant and the heat medium in the first cooling only operation mode of the air-conditioning apparatus according to Embodiment of the present invention. Referring to FIG. 7, a description will be given of the first cooling only operation mode, taking an example where a cooling load is generated only in the use side heat exchanger 26*a* and the use side heat exchanger 26*b*. In FIG. 7, pipes indicated by thick lines represent pipes through which the refrigerant and the heat medium flow. In FIG. 7, furthermore, the direction of the flow of the refrigerant is indicated by solid line arrows, and the direction of the flow of the heat medium is indicated by broken line arrows. The first cooling only operation mode is used when there is no possibility of freezing of the heat medium in the heat exchangers related to heat medium 15. For example, if the refrigerant temperatures detected by the temperature sensor 35*a* to 35*d* are higher than a first set temperature or the temperatures of the heat medium detected by the temperature sensors 34*a* to 34*d*, the temperature sensor 31*a*, and the temperature sensor 31*b* are higher than a second set temperature, it is determined that there is no possibility of freezing of the heat medium in the heat exchangers related to heat medium 15.

In the first cooling only operation mode illustrated in FIG. 7, in the outdoor unit 1, the first refrigerant passage switching device 11 is switched so as to cause the refrigerant discharged from the compressor 10 to flow into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed so that the heat medium circulates between each of the heat exchanger related to heat medium 15*a* and the heat exchanger related to heat medium 15*b* and the use side heat exchanger 26*a* and between each of the heat exchanger related to heat medium 15*a* and the heat exchanger related to heat medium 15*b* and the use side heat exchanger 26*b*. In the heat medium relay unit 3, furthermore, the opening and closing device 17*a* is opened and the opening and closing device 17*b* is closed.

First, the flow of the refrigerant in the refrigerant circuit A will be described.

A low-temperature and low-pressure refrigerant is compressed by the compressor 10 into a high-temperature and high-pressure gaseous refrigerant, which is then discharged. The high-temperature and high-pressure gaseous refrigerant discharged from the compressor 10 flows into the heat source side heat exchanger 12 through the first refrigerant passage switching device 11. Then, the gaseous refrigerant is condensed and liquefied by the heat source side heat exchanger 12, while radiating heat to the outdoor air, and then turns into a high-pressure liquid refrigerant. The high-pressure liquid refrigerant flowing out of the heat source side heat exchanger 12 flows out of the outdoor unit 1 through the check valve 13*a*, and flows into the heat medium relay unit 3 through the refrigerant pipe 4. The flow of the high-pressure liquid refrigerant flowing into the heat medium relay unit 3 is split after it flows through the opening and closing device 17*a* and then turns into a low-temperature and low-pressure two-phase refrigerant after being expanded by the expansion devices 16*a* and 16*b*.

The two-phase refrigerant flows individually into the heat exchangers related to heat medium 15*a* and 15*b* serving as evaporators (coolers) from the lower portion of the drawing, and absorbs heat from the heat medium circulating in the heat medium circuit B to cool the heat medium, so that the two-phase refrigerant is turned into a low-temperature and low-pressure gaseous refrigerant. The gaseous refrigerant flowing out of the heat exchangers related to heat medium 15*a* and 15*b* from the upper portion of the drawing flow out of the heat medium relay unit 3 through the second refrigerant passage switching devices 18*a* and 18*b*, respectively, and again flow into the outdoor unit 1 through the refrigerant pipe 4. The refrigerant flowing into the outdoor unit 1 flow through the check valve 13*d*, and are again sucked into the compressor 10 through the first refrigerant passage switching device 11 and the accumulator 19.

The circulation compositions of the refrigerant circulating in the refrigerant circuit A are measured by using the refrigerant circulation composition detection device 50 (the high-low pressure bypass pipe 4*c*, the expansion device 14, the refrigerant-refrigerant heat exchanger 27, the high-pressure side refrigerant temperature detection device 32, the low-pressure side refrigerant temperature detection device 33, the high-pressure side pressure detection device 37, and the low-pressure side pressure detection device 38). The controller 60*a* in the outdoor unit 1 and the controller 60*b* in the heat medium relay unit 3 are connected via wire or wirelessly so as to be capable of communicating with each other, and the circulation compositions calculated by the controller 60*a* in the outdoor unit 1 are transmitted via communication from the controller 60*a* in the outdoor unit 1 to the controller 60*b* in the heat medium relay unit 3.

The controller 60*b* in the heat medium relay unit 3 calculates a saturated liquid temperature and a saturated gas temperature on the basis of the circulation compositions transmitted from the controller 60*a* in the outdoor unit 1 and the pressure detected by the pressure sensor 36*a*. Further, the controller 60*b* in the heat medium relay unit 3 calculates an average temperature of the saturated liquid temperature and the saturated gas temperature to determine an evaporating temperature. Then, the controller 60*b* in the heat medium relay unit 3 controls the opening degree of the expansion device 16*a* so that superheat (the degree of superheating) obtained as a temperature difference between the temperature detected by the temperature sensor 35*a* and the calculated evaporating temperature is kept constant.

Similarly, the controller 60*b* in the heat medium relay unit 3 controls the opening degree of the expansion device 16*b* so that superheat (the degree of superheating) obtained as a temperature difference between the temperature detected by the temperature sensor 35*c* and the calculated evaporating temperature is kept constant.

The evaporating temperature may be determined on the basis of the circulation compositions transmitted from the controller 60*a* in the outdoor unit 1 and the temperature detected by the temperature sensor 35*b* (or the temperature sensor 35*d*). That is, a saturated pressure and a saturated gas temperature may be calculated by assuming that the temperature detected by the temperature sensor 35*b* is a saturated liquid temperature or the temperature of a set quality, and an average temperature of the saturated liquid temperature and the saturated gas temperature may be calculated to determine an evaporating temperature. Then, the resulting evaporating temperature may be used to control the expansion devices 16*a* and 16*b*. In this case, the pressure sensor 36*a* and the pressure sensor 36*b* may not necessarily be installed, thus achieving a low-cost system.

Next, the flow of the heat medium in the heat medium circuit B will be described.

In the first cooling only operation mode, cooling energy of the refrigerant is transferred to the heat medium in both the heat exchanger related to heat medium 15*a* and the heat exchanger related to heat medium 15*b*, and the chilled heat medium is caused by the pump 21*a* and the pump 21*b* to flow in the pipes 5.

The heat medium pressurized by and flowing out of the pump 21*a* flows into the heat exchanger related to heat medium 15*a* from the upper portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the lower portion of the drawing, and flows through the heat medium passage reversing device 20*b*, reaching the first heat medium passage switching device 23*a* and the first heat medium passage switching device 23*b*. That is, the refrigerant and the heat medium, which flow through the heat exchanger related to heat medium 15*a*, are in counter flow. The heat medium pressurized by and flowing out of the pump 21*b* flows into the heat exchanger related to heat medium 15*b* from the upper portion of the drawing through the heat medium passage reversing device 20*c*, and is chilled by the refrigerant flowing through the heat exchanger related to heat medium 15*b*. The chilled heat medium flows out of the heat exchanger related to heat medium 15*b* from the lower portion of drawing, and flows through the heat medium passage reversing device 20*d*, reaching the first heat medium passage switching device 23*a* and the first heat medium passage switching device 23*b*. That is, the refrigerant and the heat medium, which flow through the heat exchanger related to heat medium 15*b*, are in counter flow.

The heat media pumped out by the pump 21*a* and the pump 21*b* merge at each of the first heat medium passage switching device 23*a* and the first heat medium passage switching device 23*b*, and the merged heat media flow into the use side heat exchanger 26*a* and the use side heat exchanger 26*b*. Then, the heat media absorbs heat from the indoor air in the use side heat exchanger 26*a* and the use side heat exchanger 26*b* to cool the indoor space 7. Each of the use side heat exchanger 26*a* and the use side heat exchanger 26*b* serves as a cooler, and is configured such that the flow direction of the heat medium and the flow direction of the indoor air are in a counter-flow configuration.

The heat media flowing out of the use side heat exchanger 26*a* and the use side heat exchanger 26*b* flow into the heat medium flow control device 25*a* and the heat medium flow control device 25*b*, respectively. At this time, due to the action of the heat medium flow control device 25*a* and the heat medium flow control device 25*b*, the flow rates of the heat media are controlled to flow rates necessary to compensate for the air conditioning load required indoor, and the resulting heat media flow into the use side heat exchanger 26*a* and the use side heat exchanger 26*b*. The heat media flowing out of the heat medium flow control device 25*a* and the heat medium flow control device 25*b* are split into flows at the second heat medium passage switching device 22*a* and the second heat medium passage switching device 22*b*, respectively, which are again sucked into the pump 21*a* and the pump 21*b*.

As described above, in the heat exchanger related to heat medium 15*a* and the heat exchanger related to heat medium 15*b*, the refrigerant flows from the lower portion of the drawing to the upper portion of the drawing, and the heat medium flows from the upper portion of the drawing to the lower portion of the drawing, where the refrigerant and the heat medium are in counter flow. Flowing of the refrigerant and the heat medium in a counter-flow manner provides high heat exchange efficiency and improves COP.

Further, if plate-type heat exchangers are used as the heat exchanger related to heat medium 15*a* and the heat exchanger related to heat medium 15*b*, flowing of the evaporation-side refrigerant from below to above in the manner illustrated in the drawing causes the evaporated gaseous refrigerant to move upward due to the buoyant force effect, yielding a reduction in the power of the compressor and appropriate distribution of the refrigerant. If plate-type heat exchangers are used as the heat exchanger related to heat medium 15*a* and the heat exchanger related to heat medium 15*b*, furthermore, flowing of the heat medium from above to below in the manner illustrated in the drawing causes the chilled heat medium to sink due to the gravitational effect, yielding a reduction in the power of the pumps, which is efficient.

In the pipes 5 of the use side heat exchangers 26, the heat medium flows in the direction from the first heat medium passage switching devices 23 to the second heat medium passage switching devices 22 through the heat medium flow control devices 25. Further, the air conditioning load required for the indoor space 7 can be compensated for by performing control to maintain the differences between the temperature detected by the temperature sensor 31*a* or the temperature detected by the temperature sensor 31*b* and the temperatures detected by the temperature sensors 34 at a target value. Either of the temperatures obtained by the temperature sensor 31*a* and the temperature sensor 31*b* may be used as the outlet temperatures of the heat exchangers related to heat medium 15, or an average temperature thereof may be used. At this time, the opening degrees of the second heat medium passage switching devices 22 and the first heat medium passage switching devices 23 are set to be an intermediate opening degree so as to reserve the passages of the flows to both the heat exchanger related to heat medium 15*a* and the heat exchanger related to heat medium 15*b*.

In the first cooling only operation mode, since it is not necessary to cause the heat medium to flow to a use side heat exchanger 26 having no heat load (including that in a thermostat-off state), the corresponding one of the heat medium flow control devices 25 closes the passage to prevent the heat medium from flowing to the use side heat exchanger 26. In FIG. 7, the heat medium is caused to flow to the use side heat exchanger 26*a* and the use side heat exchanger 26*b* because heat load is present, whereas the use side heat exchanger 26*c* and the use side heat exchanger 26*d* have no heat load and the respectively associated heat medium flow control device 25*c* and heat medium flow control device 25*d* are fully closed. Once heat load is generated in the use side heat exchanger 26*c* or the use side heat exchanger 26*d*, the heat medium flow control device 25*c* or the heat medium flow control device 25*d* may be opened to allow the heat medium to circulate therein.

[Second Cooling Only Operation Mode]

Figure 8:
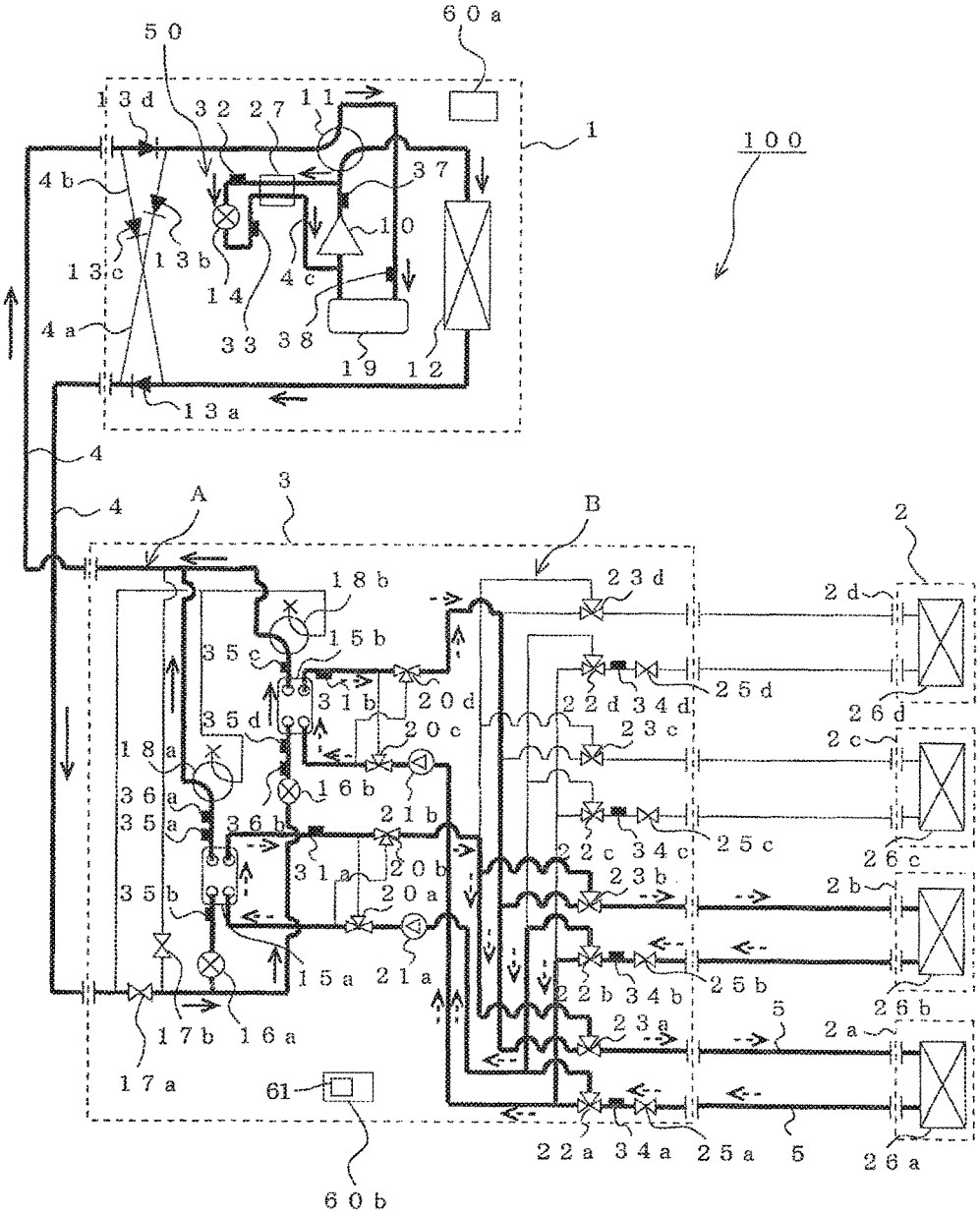
FIG. 8 is a system circuit diagram illustrating the flows of a refrigerant and a heat medium in a second cooling only operation mode of the air-conditioning apparatus according to Embodiment of the present invention.

FIG. 8 is a system circuit diagram illustrating the flows of the refrigerant and the heat medium in the second cooling only operation mode of the air-conditioning apparatus according to Embodiment of the present invention. Referring to FIG. 8, a description will be given of the second cooling only operation mode, taking an example where a cooling load is generated only in the use side heat exchanger 26*a* and the use side heat exchanger 26*b*. In FIG. 8, pipes indicated by thick lines represent pipes through which the refrigerant and the heat medium flow. In FIG. 8, furthermore, the direction of the flow of the refrigerant is indicated by solid line arrows, and the direction of the flow of the heat medium is indicated by broken line arrows. The second cooling only operation mode is used when there is a possibility of freezing of the heat medium in the heat exchangers related to heat medium 15.

Here, the determination as to whether or not there is a possibility of freezing of the heat medium in the heat exchangers related to heat medium 15 may be performed, for example, as follows. That is, if at least one of the temperatures detected by the temperature sensor 35*a* and the temperature sensor 35*b* is less than or equal to the first set temperature (for example, −3 degrees C.) or if at least one of the temperatures detected by the temperature sensor 34*a*, the temperature sensor 34*b*, and the temperature sensor 31*a* is less than or equal to the second set temperature (for example, 4 degrees C.), a freezing determination unit (i.e., a freezing processor) 61 in the controller 60*b* determines that there is a possibility of freezing of the heat medium in the heat exchanger related to heat medium 15*a*. Similarly, if at least one of the temperatures detected by the temperature sensor 35*c* and the temperature sensor 35*d* is less than or equal to the first set temperature or if at least one of the temperatures detected by the temperature sensor 34*a*, the temperature sensor 34*b*, and the temperature sensor 31*b* is less than or equal to the second set temperature, the freezing determination unit in the controller 60*b* determines that there is a possibility of freezing of the heat medium in the heat exchanger related to heat medium 15*b*.

In the operation modes in Embodiment, the controller 60*b* determines the first set temperature using, for example, a correspondence table between circulation compositions and the first set temperature or the like on the basis of the circulation compositions transmitted from the controller 60*a*. Embodiment is not limited to this form, and the first set temperature may also be determined, for example, as follows. For example, the controller 60*a* may calculate, from the circulation compositions measured by the refrigerant circulation composition detection device 50, a temperature glide of the refrigerant (non-azeotropic refrigerant) in the circulation compositions. Then, the controller 60*a* may transmit the calculated temperature glide to the controller 60*b*, and the controller 60*b* may determine the first set temperature on the basis of the transmitted temperature glide. As described above, the non-azeotropic refrigerant has a refrigerant temperature on the inlet side of the heat exchangers related to heat medium 15 lower than the refrigerant temperature on the outlet side of the heat exchangers related to heat medium 15 when the heat-medium heat exchangers 15 serve as coolers. However, if the refrigerant and heat medium flowing through the heat exchangers related to heat medium 15 are in parallel flow, the temperature of the heat medium to be subjected to heat exchange with the refrigerant on the inlet side of the heat exchangers related to heat medium 15 is higher than that of the heat medium to be subjected to heat exchange with the refrigerant on the outlet side of the heat exchangers related to heat medium 15. That is, the heat medium is less likely to be frozen if the temperature of the refrigerant on the inlet side of the heat exchangers related to heat medium 15 is low. Accordingly, by determining the first set temperature on the basis of temperature glide, it is possible for the controller 60*b* to set the first set temperature of the temperature sensors 35, which measure the refrigerant temperatures on the inlet side of the heat exchangers related to heat medium 15, to be lower than the first set temperature of the temperature sensors 35, which measure the refrigerant temperatures on the outlet side of the heat exchangers related to heat medium 15. That is, by determining the first set temperature on the basis of temperature glide, it is possible for the controller 60*b* to set the first set temperature of the temperature sensors 35, which measure the refrigerant temperatures on the inlet side of the heat exchangers related to heat medium 15, and the first set temperature of the temperature sensors 35, which measure the refrigerant temperatures on the outlet side of the heat exchangers related to heat medium 15, to be different values.

In the second cooling only operation mode, the flow of the refrigerant in the refrigerant circuit A is the same as that in the first cooling only operation mode. Further, the flow of the heat medium in the heat medium circuit B is the same as that in the first cooling only operation mode, except the flow of the heat medium around the heat exchangers related to heat medium 15*a* and 15*b*. Hereinafter, a description will be given of only a portion of the flow of the heat medium different from that in the first cooling only operation mode.

The heat medium pressurized by and flowing out of the pump 21*a* flows into the heat exchanger related to heat medium 15*a* from the lower portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the upper portion of the drawing, and flows through the heat medium passage reversing device 20*b*, reaching the first heat medium passage switching device 23*a* and the first heat medium passage switching device 23*b*. That is, the refrigerant and the heat medium, which flow through the heat exchanger related to heat medium 15*a*, are in parallel flow. The heat medium pressurized by and flowing out of the pump 21*b* flows into the heat exchanger related to heat medium 15*b* from the lower portion of the drawing through the heat medium passage reversing device 20*c*, and is chilled by the refrigerant flowing through the heat exchanger related to heat medium 15*b*. The chilled heat medium flows out of the heat exchanger related to heat medium 15*b* from the upper portion of the drawing, and flows through the heat medium passage reversing device 20*d*, reaching the first heat medium passage switching device 23*a* and the first heat medium passage switching device 23*b*. That is, the refrigerant and the heat medium, which flow through the heat exchanger related to heat medium 15*b*, are in parallel flow. The heat media pumped out by the pump 21*a* and the pump 21*b* merge at each of the first heat medium passage switching device 23*a* and the first heat medium passage switching device 23*b*, and the merged heat media flow into the use side heat exchanger 26*a* and the use side heat exchanger 26*b*.

As described above, in the heat exchanger related to heat medium 15*a* and the heat exchanger related to heat medium 15*b*, the refrigerant flows from the lower portion of the drawing to the upper portion of the drawing, and the heat medium flows from the lower portion of the drawing to the upper portion of the drawing, where the refrigerant and the heat medium are in parallel flow. Flowing of the refrigerant and the heat medium in a parallel-flow manner does not provide high heat exchange efficiency. In the heat exchangers related to heat medium 15*a* and 15*b*, on the contrary, a low-temperature heat medium and a high-temperature refrigerant undergo heat exchange on the outlet side, and a high-temperature heat medium and a low-temperature refrigerant undergo heat exchange on the inlet side, resulting in freezing of the heat medium being less likely to occur and realizing safe operation.

[Heating Only Operation Mode]

Figure 9:
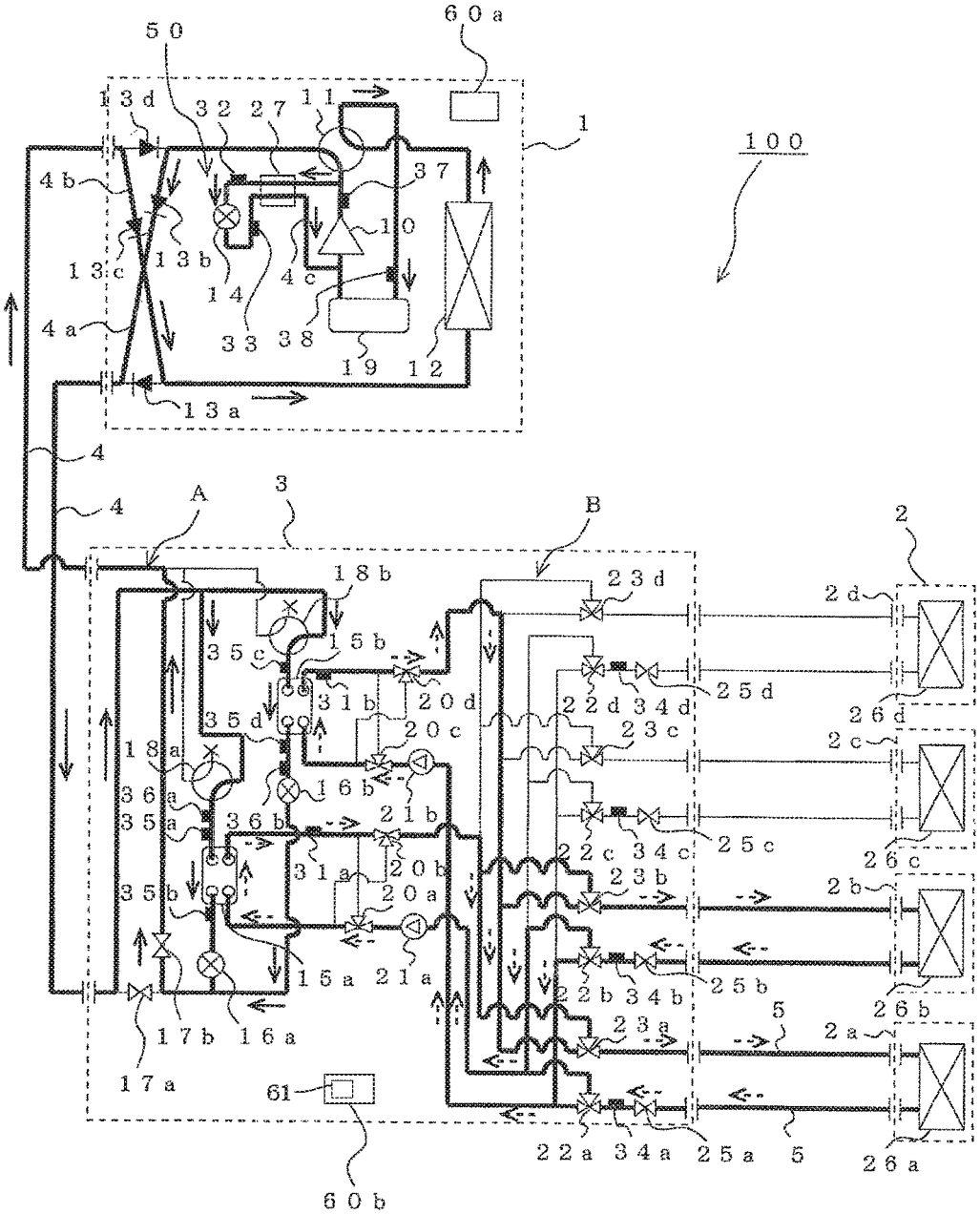
FIG. 9 is a system circuit diagram illustrating the flows of a refrigerant and a heat medium in a heating only operation mode of the air-conditioning apparatus according to Embodiment of the present invention.

FIG. 9 is a system circuit diagram illustrating the flows of the refrigerant and the heat medium in the heating only operation mode of the air-conditioning apparatus according to Embodiment of the present invention. Referring to FIG. 9, a description will be given of the heating only operation mode, taking an example where a heating load is generated only in the use side heat exchanger 26*a* and the use side heat exchanger 26*b*. In FIG. 9, pipes indicated by thick lines represent pipes through which the refrigerant and the heat medium flow. In FIG. 9, furthermore, the direction of the flow of the refrigerant is indicated by solid line arrows, and the direction of the flow of the heat medium is indicated by broken line arrows.

In the heating only operation mode illustrated in FIG. 9, in the outdoor unit 1, the first refrigerant passage switching device 11 is switched so as to cause the refrigerant discharged from the compressor 10 to flow into the heat medium relay unit 3 without flowing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed so that the heat medium circulates between each of the heat exchanger related to heat medium 15*a* and the heat exchanger related to heat medium 15*b* and the use side heat exchanger 26*a* and between each of the heat exchanger related to heat medium 15*a* and the heat exchanger related to heat medium 15*b* and the use side heat exchanger 26*b*. In the heat medium relay unit 3, furthermore, the opening and closing device 17*a* is closed and the opening and closing device 17*b* is opened.

First, the flow of the refrigerant in the refrigerant circuit A will be described.

A low-temperature and low-pressure refrigerant is compressed by the compressor 10 into a high-temperature and high-pressure gaseous refrigerant, which is then discharged. The high-temperature and high-pressure gaseous refrigerant discharged from the compressor 10 flows through the first refrigerant passage switching device 11, passing through the first connecting pipe 4*a*, and flows out of the outdoor unit 1 through the check valve 13*b*. The high-temperature and high-pressure gaseous refrigerant flowing out of the outdoor unit 1 flows into the heat medium relay unit 3 through the refrigerant pipe 4. The flow of the high-temperature and high-pressure gaseous refrigerant flowing into the heat medium relay unit 3 branches into flows, which enter the heat exchanger related to heat medium 15*a* and the heat exchanger related to heat medium 15*b* through the second refrigerant passage switching device 18*a* and the second refrigerant passage switching device 18*b*, respectively.

The high-temperature and high-pressure gaseous refrigerant flows into the heat exchangers related to heat medium 15*a* and 15*b* serving as condensers (heaters) from the upper portion of the drawing, and is condensed and liquefied, while radiating heat to the heat medium circulating in the heat medium circuit B, and then turns into a high-pressure liquid refrigerant. The liquid refrigerants flowing out of the heat exchanger related to heat medium 15*a* and the heat exchanger related to heat medium 15*b* from the lower portion of the drawing are expanded by the expansion device 16*a* and the expansion device 16*b*, respectively, and then turns into a low-temperature and low-pressure two-phase refrigerant. The two-phase refrigerant flows out of the heat medium relay unit 3 through the opening and closing device 17*b*, and again flows into the outdoor unit 1 along the refrigerant pipe 4. The refrigerant flowing into the outdoor unit 1 passes through the second connecting pipe 4*b*, and flows into the heat source side heat exchanger 12 serving as an evaporator through the check valve 13*c*.

Then, the refrigerant flowing into the heat source side heat exchanger 12 absorbs heat from outdoor air in the heat source side heat exchanger 12, and is turned into a low-temperature and low-pressure gaseous refrigerant. The low-temperature and low-pressure gaseous refrigerant flowing out of the heat source side heat exchanger 12 is again sucked into the compressor 10 through the first refrigerant passage switching device 11 and the accumulator 19.

The circulation compositions of the refrigerant circulating in the refrigerant circuit A are measured by using the refrigerant circulation composition detection device 50 (the high-low pressure bypass pipe 4*c*, the expansion device 14, the refrigerant-refrigerant heat exchanger 27, the high-pressure side refrigerant temperature detection device 32, the low-pressure side refrigerant temperature detection device 33, the high-pressure side pressure detection device 37, and the low-pressure side pressure detection device 38). The controller 60*a* in the outdoor unit 1 and the controller 60*b* in the heat medium relay unit 3 are connected via wire or wirelessly so as to be capable of communicating with each other, and the circulation compositions calculated by the controller 60*a* in the outdoor unit 1 are transmitted via communication from the controller 60*a* in the outdoor unit 1 to the controller 60*b* in the heat medium relay unit 3.

The controller 60*b* in the heat medium relay unit 3 calculates a saturated liquid temperature and a saturated gas temperature on the basis of the circulation compositions transmitted from the controller 60*a* in the outdoor unit 1 and the pressure detected by the pressure sensor 36*b*. Further, the controller 60*b* in the heat medium relay unit 3 calculates an average temperature of the saturated liquid temperature and the saturated gas temperature to determine a condensing temperature. Then, the controller 60*b* in the heat medium relay unit 3 controls the opening degree of the expansion device 16*a* so that subcool (degree of subcooling) obtained as a temperature difference between the temperature detected by the temperature sensor 35*b* and the calculated condensing temperature is kept constant.

Similarly, the controller 60*b* in the heat medium relay unit 3 controls the opening degree of the expansion device 16*b* so that subcool (degree of subcooling) obtained as a temperature difference between the temperature detected by the temperature sensor 35*d* and the calculated condensing temperature.

Next, the flow of the heat medium in the heat medium circuit B will be described.

In the heating only operation mode, heating energy of the refrigerant is transferred to the heat medium in both the heat exchanger related to heat medium 15*a* and the heat exchanger related to heat medium 15*b*, and the warmed heat medium is caused by the pump 21*a* and the pump 21*b* to flow in the pipes 5.

The heat medium pressurized by and flowing out of the pump 21*a* flows into the heat exchanger related to heat medium 15*a* from the lower portion of the drawing through the heat medium passage reversing device 20*a*, and is warmed by the refrigerant flowing through the heat exchanger related to heat medium 15*a*. The warmed heat medium flows out of the heat exchanger related to heat medium 15*a* from the upper portion of the drawing, and flows through the heat medium passage reversing device 20*b*, reaching the first heat medium passage switching device 23*a* and the first heat medium passage switching device 23*b*. That is, the refrigerant and the heat medium, which flow through the heat exchanger related to heat medium 15*a*, are in counter flow. The heat medium pressurized by and flowing out of the pump 21*b* flows into the heat exchanger related to heat medium 15*b* from the lower portion of the drawing through the heat medium passage reversing device 20*c*, and is warmed by the refrigerant flowing through the heat exchanger related to heat medium 15*b*. The warmed heat medium flows out of the heat exchanger related to heat medium 15*b* from the upper portion of the drawing, and flows through the heat medium passage reversing device 20*d*, reaching the first heat medium passage switching device 23*a* and the first heat medium passage switching device 23*b*. That is, the refrigerant and the heat medium, which flow through the heat exchanger related to heat medium 15*b*, are in counter flow.

The heat media pumped out by the pump 21*a* and the pump 21*b* merge at each of the first heat medium passage switching device 23*a* and the first heat medium passage switching device 23*b*, and the merged heat media flow into the use side heat exchanger 26*a* and the use side heat exchanger 26*b*. Then, the heat media radiate heat to indoor air in the use side heat exchanger 26*a* and use side heat exchanger 26*b* to heat the indoor space 7. Each of the use side heat exchanger 26*a* and the use side heat exchanger 26*b* serves as a heater, and is configured such that the flow direction of the heat medium is the same as that when serving as a cooler and the flow direction of the heat medium and the flow direction of the indoor air are in a counter-flow configuration.

The heat media flowing out of the use side heat exchanger 26*a* and the use side heat exchanger 26*b* flow into the heat medium flow control device 25*a* and the heat medium flow control device 25*b*, respectively. At this time, due to the action of the heat medium flow control device 25*a* and the heat medium flow control device 25*b*, the flow rates of the heat media are controlled to flow rates necessary to compensate for the air conditioning load required indoor, and the resulting heat media flow into the use side heat exchanger 26*a* and the use side heat exchanger 26*b*. The heat media flowing out of the heat medium flow control device 25*a* and the heat medium flow control device 25*b* are split into flows at the second heat medium passage switching device 22*a* and the second heat medium passage switching device 22*b*, respectively, which are again sucked into the pump 21*a* and the pump 21*b*.

As described above, in the heat exchanger related to heat medium 15*a* and the heat exchanger related to heat medium 15*b*, the refrigerant flows from the upper portion of the drawing to the lower portion of the drawing, and the heat medium flows from the lower portion of the drawing to the upper portion of the drawing, where the refrigerant and the heat medium are in counter flow. Flowing of the refrigerant and the heat medium in a counter-flow manner provides high heat exchange efficiency and improves COP.

Further, if plate-type heat exchangers are used as the heat exchanger related to heat medium 15*a* and the heat exchanger related to heat medium 15*b*, flowing of the condensing-side refrigerant from above to below in the manner illustrated in the drawing causes the condensed liquid refrigerant to move downward due to the gravitational effect, yielding a reduction in the power of the compressor. If plate-type heat exchangers are used as the heat exchanger related to heat medium 15*a* and the heat exchanger related to heat medium 15*b*, furthermore, flowing of the heat medium from below to above in manner illustrated in the drawing causes the warmed heat medium to float due to the buoyant force effect, yielding a reduction in the power of the pumps, which is efficient.

In the pipes 5 of the use side heat exchangers 26, the heat medium flows in the direction from the first heat medium passage switching devices 23 to the second heat medium passage switching devices 22 through the heat medium flow control devices 25. Further, the air conditioning load required for the indoor space 7 can be compensated for by performing control to maintain the differences between the temperature detected by the temperature sensor 31*a* or the temperature detected by the temperature sensor 31*b* and the temperatures detected by the temperature sensors 34 at a target value. Either of the temperatures obtained by the temperature sensor 31*a* and the temperature sensor 31*b* may be used as the outlet temperatures of the heat exchangers related to heat medium 15, or an average temperature thereof may be used.

At this time, the opening degrees of the second heat medium passage switching devices 22 and the first heat medium passage switching devices 23 are set to be an intermediate opening degree so as to reserve the passages of the flows to both the heat exchanger related to heat medium 15*a* and the heat exchanger related to heat medium 15*b*. Furthermore, the flow rates of the heat media flowing through the use side heat exchangers 26 should be controlled using the temperature differences between the inlet and outlet temperatures. The temperatures of the heat media on the inlet side of the use side heat exchangers 26 are substantially the same as the temperatures detected by the temperature sensors 31. Thus, the number of temperature sensors can be reduced by controlling the flow rates of the heat media flowing through the use side heat exchangers 26 using the temperatures detected by the temperature sensors 31, thus achieving a low-cost system.

In the heating only operation mode, since it is not necessary to cause the heat medium to flow to a use side heat exchanger 26 having no heat load (including that in a thermostat-off state), the corresponding one of the heat medium flow control devices 25 closes the passage to prevent the heat medium from flowing to the use side heat exchanger 26. In FIG. 9, the heat medium is caused to flow to the use side heat exchanger 26*a* and the use side heat exchanger 26*b* because heat load is present, whereas the use side heat exchanger 26*c* and the use side heat exchanger 26*d* have no heat load and the respectively associated heat medium flow control device 25*c* and heat medium flow control device 25*d* are fully closed. Once heat load is generated in the use side heat exchanger 26*c* or the use side heat exchanger 26*d*, the heat medium flow control device 25*c* or the heat medium flow control device 25*d* may be opened to allow the heat medium to circulate therein.

[First Cooling Main Operation Mode]

Figure 10:
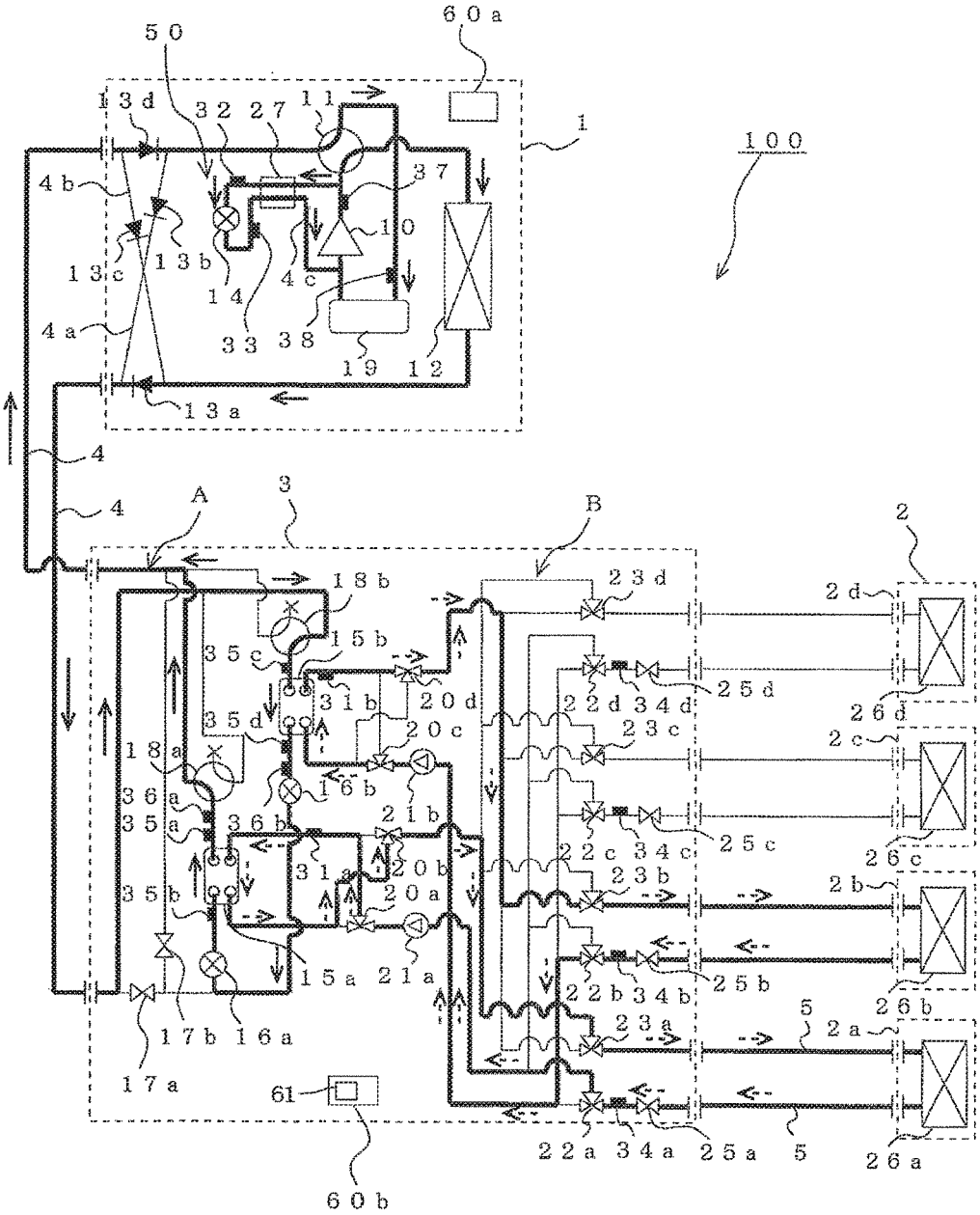
FIG. 10 is a system circuit diagram illustrating the flows of a refrigerant and a heat medium in a first cooling main operation mode of the air-conditioning apparatus according to Embodiment of the present invention.

FIG. 10 is a system circuit diagram illustrating the flows of the refrigerant and the heat medium in the first cooling main operation mode of the air-conditioning apparatus according to Embodiment of the present invention. Referring to FIG. 10, a description will be given of the first cooling main operation mode, taking an example where a cooling load is generated in the use side heat exchanger 26*a* and a heating load is generated in the use side heat exchanger 26*b*. In FIG. 10, pipes indicated by thick lines represent pipes through which the refrigerant and the heat medium circulate. In FIG. 10, furthermore, the direction of the flow of the refrigerant is indicated by solid line arrows, and the direction of the flow of the heat medium is indicated by broken line arrows.

In the first cooling main operation mode illustrated in FIG. 10, in the outdoor unit 1, the first refrigerant passage switching device 11 is switched so as to cause the refrigerant discharged from the compressor 10 to flow into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed so that the heat medium circulates between the heat exchanger related to heat medium 15*a* and the use side heat exchanger 26*a* and between the heat exchanger related to heat medium 15*b* and the use side heat exchanger 26*b*. In the heat medium relay unit 3, furthermore, the opening and closing device 17*a* and the opening and closing device 17*b* are closed.

First, the flow of the refrigerant in the refrigerant circuit A will be described.

A low-temperature and low-pressure refrigerant is compressed by the compressor 10 into a high-temperature and high-pressure gaseous refrigerant, which is then discharged. The high-temperature and high-pressure gaseous refrigerant discharged from the compressor 10 flows into the heat source side heat exchanger 12 through the first refrigerant passage switching device 11. Then, the gaseous refrigerant is condensed, while radiating heat to outdoor air in the heat source side heat exchanger 12, and then turns into a two-phase refrigerant. The two-phase refrigerant flowing out of the heat source side heat exchanger 12 flows out of the outdoor unit 1 through the check valve 13*a*, and flows into the heat medium relay unit 3 through the refrigerant pipe 4. The two-phase refrigerant flowing into the heat medium relay unit 3 flows into the heat exchanger related to heat medium 15*b* serving as a condenser through the second refrigerant passage switching device 18*b*.

The two-phase refrigerant flows into the heat exchanger related to heat medium 15*b* serving as a condenser from the upper portion of the drawing, and is condensed and liquefied, while radiating heat to the heat medium circulating in the heat medium circuit B, and then turns into a liquid refrigerant. The liquid refrigerant flowing out of the heat exchanger related to heat medium 15*b* from the lower portion of the drawing is expanded by the expansion device 16*b* and then turns into a low-pressure two-phase refrigerant. The low-pressure two-phase refrigerant flows into the heat exchanger related to heat medium 15*a* serving as an evaporator through the expansion device 16*a*. The low-pressure two-phase refrigerant flowing into the heat exchanger related to heat medium 15*a* from the lower portion of the drawing absorbs heat from the heat medium circulating in the heat medium circuit B to cool the heat medium, so that the two-phase refrigerant is turned into a low-pressure gaseous refrigerant. The gaseous refrigerant flows out of the heat exchanger related to heat medium 15*a* from the upper portion of the drawing, flows out of the heat medium relay unit 3 through the second refrigerant passage switching device 18*a*, and again flows into the outdoor unit 1 along the refrigerant pipe 4. The refrigerant flowing into the outdoor unit 1 flows through the check valve 13*d*, and is again sucked into the compressor 10 through the first refrigerant passage switching device 11 and the accumulator 19.

The circulation compositions of the refrigerant circulating in the refrigerant circuit A are measured by using the refrigerant circulation composition detection device 50 (the high-low pressure bypass pipe 4*c*, the expansion device 14, the refrigerant-refrigerant heat exchanger 27, the high-pressure side refrigerant temperature detection device 32, the low-pressure side refrigerant temperature detection device 33, the high-pressure side pressure detection device 37, and the low-pressure side pressure detection device 38). The controller 60*a* in the outdoor unit 1 and the controller 60*b* in the heat medium relay unit 3 are connected via wire or wirelessly so as to be capable of communicating with each other, and the circulation compositions calculated by the controller 60*a* in the outdoor unit 1 are transmitted via communication from the controller 60*a* in the outdoor unit 1 to the controller 60*b* in the heat medium relay unit 3.

The controller 60*b* in the heat medium relay unit 3 calculates a saturated liquid temperature and a saturated gas temperature on the basis of the circulation compositions transmitted from the controller 60*a* in the outdoor unit 1 and the pressure detected by the pressure sensor 36*a*. Further, the controller 60*b* in the heat medium relay unit 3 calculates an average temperature of the saturated liquid temperature and the saturated gas temperature to determine an evaporating temperature of the heat exchanger related to heat medium 15*a*. Then, the controller 60*b* in the heat medium relay unit 3 controls the opening degree of the expansion device 16*b* so that superheat (degree of superheating) obtained as a temperature difference between the temperature detected by the temperature sensor 35*a* and the calculated evaporating temperature is kept constant. In addition, the expansion device 16*a* is fully opened.

The controller 60*b* in the heat medium relay unit 3 may calculate a saturated liquid temperature and a saturated gas temperature on the basis of the circulation compositions transmitted from the controller 60*a* in the outdoor unit 1 and the pressure detected by the pressure sensor 36*b*. Then, the controller 60*b* in the heat medium relay unit 3 may calculate an average temperature of the saturated liquid temperature and the saturated gas temperature to determine a condensing temperature, and may control the opening degree of the expansion device 16*b* so that subcool (degree of subcooling) obtained as a temperature difference between the temperature detected by the temperature sensor 35*d* and the calculated condensing temperature is kept constant. In addition, the expansion device 16*b* may be fully opened and the expansion device 16*a* may be used to control superheat or subcool.

A saturated pressure and a saturated gas temperature may be calculated by assuming that the temperature detected by the temperature sensor 35*b* is a saturated liquid temperature or the temperature of a set quality on the basis of the circulation compositions transmitted via communication from the outdoor unit 1 and the temperature sensor 35*b*, and an average temperature of the saturated liquid temperature and the saturated gas temperature may be calculated to determine an evaporating temperature. Then, the determined evaporating temperature may be used to control the expansion devices 16*a* and 16*b*. In this case, the installation of the pressure sensor 36*a* may be omitted, thus achieving a low-cost system.

Next, the flow of the heat medium in the heat medium circuit B will be described.

In the first cooling main operation mode, heating energy of the refrigerant is transferred to the heat medium in the heat exchanger related to heat medium 15*b*, and the warmed heat medium is caused by the pump 21*b* to flow in the pipes 5. In the first cooling main operation mode, furthermore, cooling energy of the refrigerant is transferred to the heat medium in the heat exchanger related to heat medium 15*a*, and the chilled heat medium is caused by the pump 21*a* to flow in the pipes 5.

The heat medium pressurized by and flowing out of the pump 21*b* flows into the heat exchanger related to heat medium 15*b* from the lower portion of the drawing through the heat medium passage reversing device 20*c*, and is warmed by the refrigerant flowing through the heat exchanger related to heat medium 15*b*. The warmed heat medium flows out of the heat exchanger related to heat medium 15*b* from the upper portion of the drawing, and flows through the heat medium passage reversing device 20*d*, reaching the first heat medium passage switching device 23*b*. That is, the refrigerant and the heat medium, which flow through the heat exchanger related to heat medium 15*b*, are in counter flow. The heat medium pressurized by and flowing out of the pump 21*a* flows into the heat exchanger related to heat medium 15*a* from the upper portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the lower portion of the drawing, and flows through the heat medium passage reversing device 20*b*, reaching the first heat medium passage switching device 23*a*. That is, the refrigerant and the heat medium, which flow through the heat exchanger related to heat medium 15*a*, are in counter flow.

The heat medium transmitted through the first heat medium passage switching device 23*b* flows into the use side heat exchanger 26*b*, and radiates heat to indoor air to heat the indoor space 7. Further, the heat medium transmitted through the first heat medium passage switching device 23*a* flows into the use side heat exchanger 26*a*, and absorbs heat from indoor air to cool the indoor space 7. At this time, due to the action of the heat medium flow control device 25*a* and the heat medium flow control device 25*b*, the flow rates of the heat media are controlled to flow rates necessary to compensate for the air conditioning load required indoor, and the resulting heat media flow into the use side heat exchanger 26*a* and the use side heat exchanger 26*b*. The heat medium, whose temperature has been slightly reduced after being transmitted through the use side heat exchanger 26*b*, passes through the heat medium flow control device 25*b* and the second heat medium passage switching device 22*b*, and is again sucked into the pump 21*b*. The heat medium, whose temperature has been slightly increased after being transmitted through the use side heat exchanger 26*a*, passes through the heat medium flow control device 25*a* and the second heat medium passage switching device 22*a*, and is again sucked into the pump 21*a*. While the use side heat exchanger 26*a* serves as a cooler and the use side heat exchanger 26*b* serves as a heater, both are configured such that the flow direction of the heat medium and the flow direction of the indoor air are in a counter-flow configuration.

During this period, the hot heat medium and the cold heat medium are not mixed due to the action of the second heat medium passage switching devices 22 and the first heat medium passage switching devices 23, and are introduced into a use side heat exchanger 26 having a heating load and a use side heat exchanger 26 having a cooling load, respectively. In the pipes 5 of the use side heat exchangers 26, the heat medium flows in the direction from the first heat medium passage switching devices 23 to the second heat medium passage switching devices 22 through the heat medium flow control devices 25 on both the heating side and the cooling side. Further, the air conditioning load required for the indoor space 7 can be compensated for by performing control to maintain the differences between the temperature detected by the temperature sensor 31*b* and the temperatures detected by the temperature sensors 34 on the heating side or between the temperatures detected by the temperature sensors 34 and the temperature detected by the temperature sensor 31*a* on the cooling side at a target value.

As described above, in the heat exchanger related to heat medium 15*a* serving as a cooler, the refrigerant flows from the lower portion of the drawing to the upper portion of the drawing, and the heat medium flows from the upper portion of the drawing to the lower portion of the drawing, where the refrigerant and the heat medium are in counter flow. Further, in the heat exchanger related to heat medium 15*b* serving as a heater, the refrigerant flows from the upper portion of the drawing to the lower portion of the drawing, and the heat medium flows from the lower portion of the drawing to the upper portion of the drawing, where the refrigerant and the heat medium are in counter flow. Flowing of the refrigerant and the heat medium in a counter-flow manner provides high heat exchange efficiency and improves COP.

Further, if a plate-type heat exchanger is used as the heat exchanger related to heat medium 15*a* serving as a cooler, flowing of the evaporation-side refrigerant from below to above in the manner illustrated in the drawing causes the evaporated gaseous refrigerant to move upward due to the buoyant force effect, yielding a reduction in the power of the compressor and appropriate distribution of the refrigerant. If a plate-type heat exchanger is used as the heat exchanger related to heat medium 15*a* serving as a cooler, furthermore, flowing of the heat medium from above to below in the manner illustrated in the drawing causes the chilled heat medium to sink due to the gravitational effect, yielding a reduction in the power of the pump, which is efficient.

Further, if a plate-type heat exchanger is used as the heat exchanger related to heat medium 15*b* serving as a heater, flowing of the condensing-side refrigerant from above to below in the manner illustrated in the drawing causes the condensed liquid refrigerant to move downward due to the gravitational effect, yielding a reduction in the power of the compressor. If a plate-type heat exchanger is used as the heat exchanger related to heat medium 15*b* serving as a heater, furthermore, flowing of the heat medium from below to above in the manner illustrated in the drawing causes the warmed heat medium to float due to the buoyant force effect, yielding a reduction in the power of the pumps, which is efficient.

In the first cooling main operation mode, since it is not necessary to cause the heat medium to flow to a use side heat exchanger 26 having no heat load (including that in a thermostat-off state), the corresponding one of the heat medium flow control devices 25 closes the passage to prevent the heat medium from flowing to the use side heat exchanger 26. In FIG. 10, the heat medium is caused to flow to the use side heat exchanger 26*a* and the use side heat exchanger 26*b* because heat load is present, whereas the use side heat exchanger 26*c* and the use side heat exchanger 26*d* have no heat load and the respectively associated heat medium flow control device 25*c* and heat medium flow control device 25*d* are fully closed. Once heat load is generated in the use side heat exchanger 26*c* or the use side heat exchanger 26*d*, the heat medium flow control device 25*c* or the heat medium flow control device 25*d* may be opened to allow the heat medium to circulate therein.

[Second Cooling Main Operation Mode]

Figure 11:
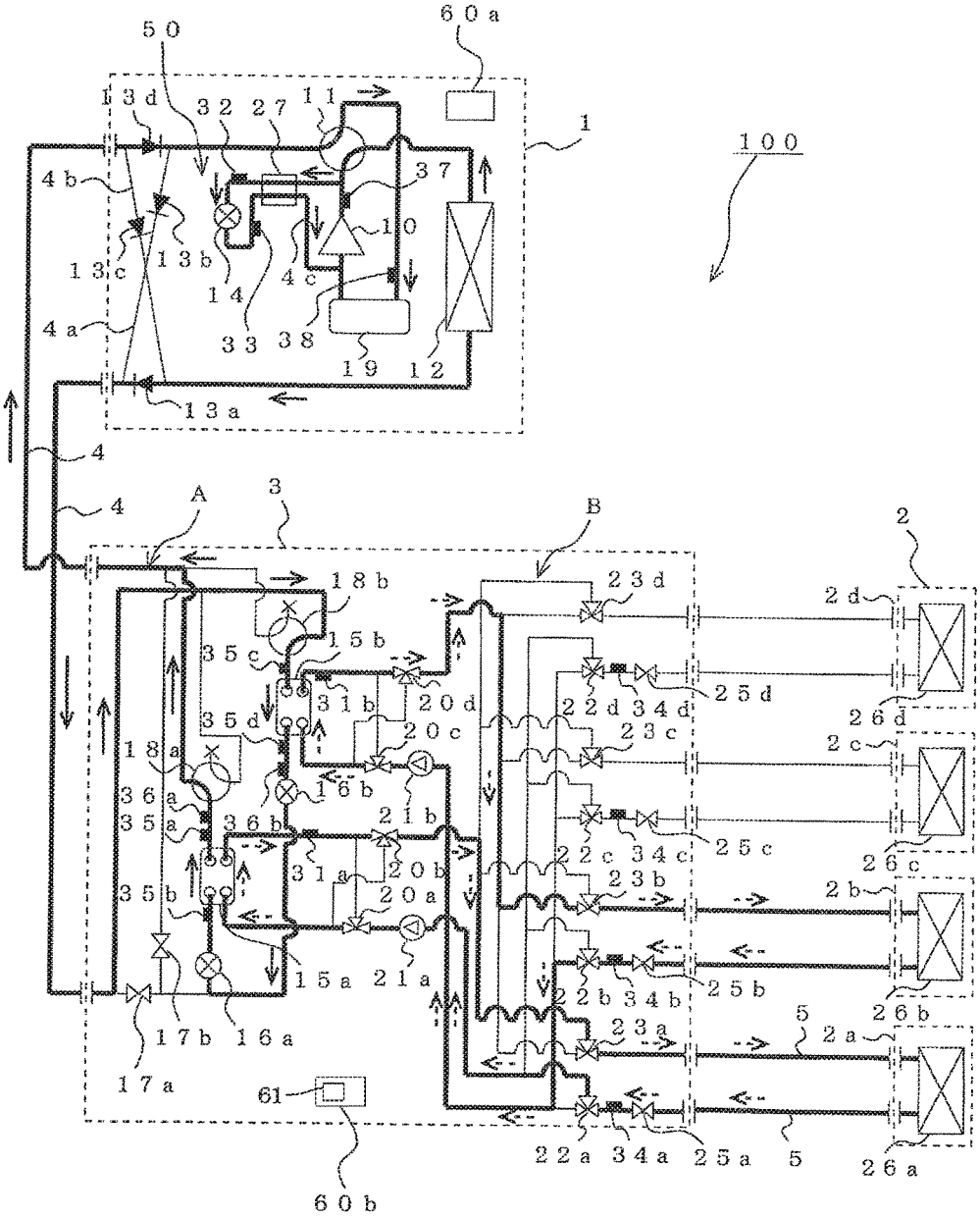
FIG. 11 is a system circuit diagram illustrating the flows of a refrigerant and a heat medium in a second cooling main operation mode of the air-conditioning apparatus according to Embodiment of the present invention.

FIG. 11 is a system circuit diagram illustrating the flows of the refrigerant and the heat medium in the second cooling main operation mode of the air-conditioning apparatus according to Embodiment of the present invention. Referring to FIG. 11, a description will be given of the second cooling main operation mode, taking an example where a cooling load is generated in the use side heat exchanger 26*a* and a heating load is generated in the use side heat exchanger 26*b*. In FIG. 11, pipes indicated by thick lines represent pipes through which the refrigerant and the heat medium circulate. In FIG. 11, furthermore, the direction of the flow of the refrigerant is indicated by solid line arrows, and the direction of the flow of the heat medium is indicated by broken line arrows. The second cooling only operation mode is used when there is a possibility of freezing of the heat medium in the heat exchanger related to heat medium 15*a*.

Here, the determination as to whether or not there is a possibility of freezing of the heat medium in the heat exchanger related to heat medium 15*a* may be performed, for example, as follows. That is, if at least one of the temperatures detected by the temperature sensor 35*a* and the temperature sensor 35*b* is less than or equal to the first set temperature (for example, −3 degrees C.) or at least one of the temperatures detected by the temperature sensor 34*a* and the temperature sensor 31*a* is less than or equal to the second set temperature (for example, 4 degrees C.), the freezing determination unit in the controller 60*b* determines that there is a possibility of freezing of the heat medium in the heat exchanger related to heat medium 15*a*.

In the second cooling main operation mode, the flow of the refrigerant in the refrigerant circuit A is the same as that in the first cooling main operation mode. Further, the flow of the heat medium in the heat medium circuit B is the same as that in the first cooling main operation mode, except the flow of the heat medium around the heat exchangers related to heat medium 15*a* and 15*b*. Thus, a description will be given of only a portion of the flow of the heat medium different from that in the first cooling main operation mode.

The heat medium pressurized by and flowing out of the pump 21*b* flows into the heat exchanger related to heat medium 15*b* from the lower portion of the drawing through the heat medium passage reversing device 20*c*, and is warmed by the refrigerant flowing through the heat exchanger related to heat medium 15*b*. The warmed heat medium flows out of the heat exchanger related to heat medium 15*b* from the upper portion of the drawing, and flows through the heat medium passage reversing device 20*d*, reaching the first heat medium passage switching device 23*b*. That is, the refrigerant and the heat medium, which flow through the heat exchanger related to heat medium 15*b*, are in counter flow. The heat medium pressurized by and flowing out of the pump 21*a* flows into the heat exchanger related to heat medium 15*a* from the lower portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the upper portion of the drawing, and flows through the heat medium passage reversing device 20*b*, reaching the first heat medium passage switching device 23*a*. That is, the refrigerant and the heat medium, which flow through the heat exchanger related to heat medium 15*a*, are in parallel flow. The hot heat medium and the cold heat medium are not mixed due to the action of the second heat medium passage switching devices 22 and the first heat medium passage switching devices 23, and are introduced into a use side heat exchanger 26 having a heating load and a use side heat exchanger 26 having a cooling load, respectively.

As described above, in the heat exchanger related to heat medium 15*b* serving as a heater, the refrigerant flows from the upper portion of the drawing to the lower portion of the drawing, and the heat medium flows from the lower portion of the drawing to the upper portion of the drawing, where the refrigerant and the heat medium are in counter flow. Flowing of the refrigerant and the heat medium in a counter-flow manner provides high heat exchange efficiency and improves COP. Further, in the heat exchanger related to heat medium 15*a* serving as a cooler, the refrigerant flows from the lower portion of the drawing to the upper portion of the drawing, and the heat medium flows from the lower portion of the drawing to the upper portion of the drawing, where the refrigerant and the heat medium are in parallel flow. Flowing of the refrigerant and the heat medium in a parallel-flow manner does not provide high heat exchange efficiency. In the heat exchanger related to heat medium 15*a*, on the contrary, a low-temperature heat medium and a high-temperature refrigerant undergo heat exchange on the outlet side, and a high-temperature heat medium and a low-temperature refrigerant undergo heat exchange on the inlet side, resulting in freezing of the heat medium being less likely to occur and realizing safe operation.

[First Heating Main Operation Mode]

Figure 12:
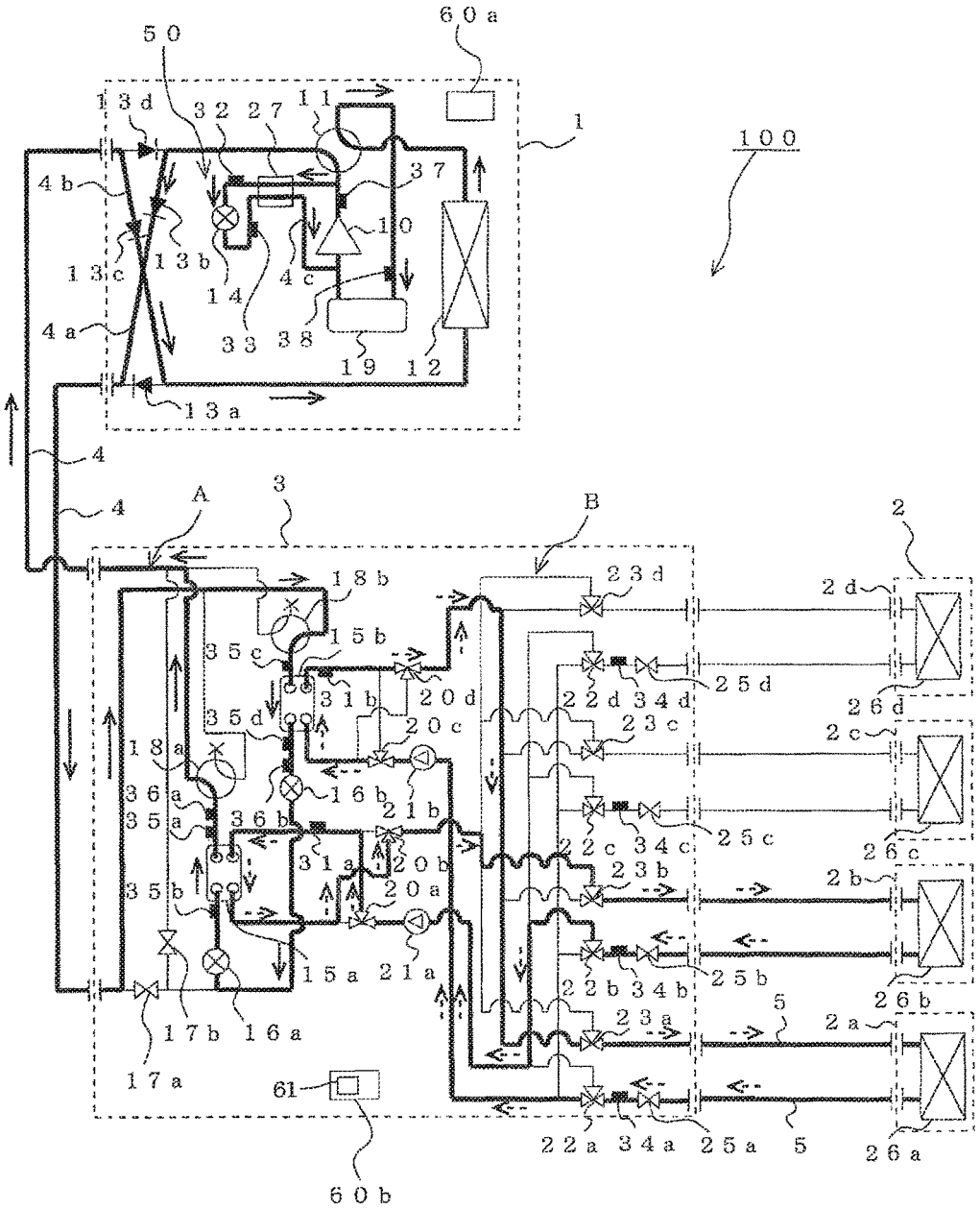
FIG. 12 is a system circuit diagram illustrating the flows of a refrigerant and a heat medium in a first heating main operation mode of the air-conditioning apparatus according to Embodiment of the present invention.

FIG. 12 is a system circuit diagram illustrating the flows of the refrigerant and the heat medium in the first heating main operation mode of the air-conditioning apparatus according to Embodiment of the present invention. Referring to FIG. 12, a description will be given of the first heating main operation mode, taking an example where a heating load is generated in the use side heat exchanger 26*a* and a cooling load is generated in the use side heat exchanger 26*b*. In FIG. 12, pipes indicated by thick lines represent pipes through which the refrigerant and the heat medium circulate. In FIG. 12, furthermore, the direction of the flow of the refrigerant is indicated by solid line arrows, and the direction of the flow of the heat medium is indicated by broken line arrows.

In the first heating main operation mode illustrated in FIG. 12, in the outdoor unit 1, the first refrigerant passage switching device 11 is switched so as to cause the refrigerant discharged from the compressor 10 to flow into the heat medium relay unit 3 without flowing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are fully closed so that the heat medium circulates between each of the heat exchanger related to heat medium 15*a* and the heat exchanger related to heat medium 15*b* and the use side heat exchanger 26*a* and between each of the heat exchanger related to heat medium 15*a* and the heat exchanger related to heat medium 15*b* and the use side heat exchanger 26*b*. In the heat medium relay unit 3, furthermore, the opening and closing device 17*a* and the opening and closing device 17*b* are closed.

First, the flow of the refrigerant in the refrigerant circuit A will be described.

A low-temperature and low-pressure refrigerant is compressed by the compressor 10 into a high-temperature and high-pressure gaseous refrigerant, which is then discharged. The high-temperature and high-pressure gaseous refrigerant discharged from the compressor 10 flows through the first refrigerant passage switching device 11, passing through the first connecting pipe 4*a*, and flows out of the outdoor unit 1 through the check valve 13*b*. The high-temperature and high-pressure gaseous refrigerant flowing out of the outdoor unit 1 flows into the heat medium relay unit 3 through the refrigerant pipe 4. The high-temperature and high-pressure gaseous refrigerant flowing into the heat medium relay unit 3 flows into the heat exchanger related to heat medium 15*b* serving as a condenser through the second refrigerant passage switching device 18*b*.

The gaseous refrigerant flows into the heat exchanger related to heat medium 15*b* serving as a condenser from the upper portion of the drawing, and is condensed and liquefied, while radiating heat to the heat medium circulating in the heat medium circuit B, into a liquid refrigerant. The liquid refrigerant flowing out of the heat exchanger related to heat medium 15*b* is expanded by the expansion device 16*b* into a low-pressure two-phase refrigerant. The low-pressure two-phase refrigerant flows into the heat exchanger related to heat medium 15*a* serving as an evaporator through the expansion device 16*a*. The low-pressure two-phase refrigerant flowing into the heat exchanger related to heat medium 15*a* from the lower portion of the drawing evaporates by absorbing heat from the heat medium circulating in the heat medium circuit B, and cools the heat medium. The low-pressure gaseous refrigerant flows out of the heat exchanger related to heat medium 15*a* from the upper portion of the drawing, flows out of the heat medium relay unit 3 through the second refrigerant passage switching device 18*a*, and again flows into the outdoor unit 1 along the refrigerant pipe 4.

The controller 60*b* in the heat medium relay unit 3 calculates a saturated liquid temperature and a saturated gas temperature on the basis of the circulation compositions transmitted from the controller 60*a* in the outdoor unit 1 and the pressure detected by the pressure sensor 36*b*. Further, the controller 60*b* in the heat medium relay unit 3 calculates an average temperature of the saturated liquid temperature and the saturated gas temperature to determine a condensing temperature. Then, the controller 60*b* in the heat medium relay unit 3 controls the opening degree of the expansion device 16*b* so that subcool (degree of subcooling) obtained as a temperature difference between the temperature detected by the temperature sensor 35*d* and the calculated condensing temperature is kept constant. At this time, the expansion device 16*a* is fully opened. Note that the expansion device 16*b* may be fully opened and the expansion device 16*a* may be used to control subcool.

A saturated pressure and a saturated gas temperature may be calculated by assuming that the temperature detected by the temperature sensor 35*b* is a saturated liquid temperature or the temperature of a set quality on the basis of the circulation compositions transmitted via communication from the outdoor unit 1 and the temperature sensor 35*b*, and an average temperature of the saturated liquid temperature and the saturated gas temperature may be calculated to determine an evaporating temperature. Then, the determined evaporating temperature may be used to control the expansion devices 16*a* and 16*b*. In this case, the installation of the pressure sensor 36*a* may be omitted, thus achieving a low-cost system.

Next, the flow of the heat medium in the heat medium circuit B will be described.

In the first heating main operation mode, heating energy of the refrigerant is transferred to the heat medium in the heat exchanger related to heat medium 15*b*, and the warmed heat medium is caused by the pump 21*b* to flow in the pipes 5. In the first heating main operation mode, furthermore, cooling energy of the refrigerant is transferred to the heat medium in the heat exchanger related to heat medium 15*a*, and the chilled heat medium is caused by the pump 21*a* to flow in the pipes 5.

The heat medium pressurized by and flowing out of the pump 21*b* flows into the heat exchanger related to heat medium 15*b* from the lower portion of the drawing through the heat medium passage reversing device 20*c*, and is warmed by the refrigerant flowing through the heat exchanger related to heat medium 15*b*. The warmed heat medium flows out of the heat exchanger related to heat medium 15*b* from the upper portion of the drawing, and flows through the heat medium passage reversing device 20*d*, reaching the first heat medium passage switching device 23*a*. That is, the refrigerant and the heat medium, which flow through the heat exchanger related to heat medium 15*b*, are in counter flow. The heat medium pressurized by and flowing out of the pump 21*a* flows into the heat exchanger related to heat medium 15*a* from the upper portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the lower portion of the drawing, and flows through the heat medium passage reversing device 20*b*, reaching the first heat medium passage switching device 23*b*. That is, the refrigerant and the heat medium, which flow through the heat exchanger related to heat medium 15*a*, are in counter flow.

The heat medium transmitted through the first heat medium passage switching device 23*a* flows into the use side heat exchanger 26*a*, and radiates heat to indoor air to heat the indoor space 7. Further, the heat medium transmitted through the first heat medium passage switching device 23*b* flows into the use side heat exchanger 26*b*, and absorbs heat from indoor air to cool the indoor space 7. At this time, due to the action of the heat medium flow control device 25*a* and the heat medium flow control device 25*b*, the flow rates of the heat media are controlled to flow rates necessary to compensate for the air conditioning load required indoor, and the resulting heat media flow into the use side heat exchanger 26*a* and the use side heat exchanger 26*b*. The heat medium, whose temperature has been slightly reduced after being transmitted through the use side heat exchanger 26*a*, passes through the heat medium flow control device 25*a* and the second heat medium passage switching device 22*a*, and is again sucked into the pump 21*b*. The heat medium, whose temperature has been slightly increased after being transmitted through the use side heat exchanger 26*b*, passes through the heat medium flow control device 25*b* and the second heat medium passage switching device 22*b*, and is again sucked into the pump 21*a*. While the use side heat exchanger 26*a* serves as a heater and the use side heat exchanger 26*b* serves as a cooler, both are configured such that the flow direction of the heat medium and the flow direction of the indoor air are in a counter-flow configuration.

During this period, the hot heat medium and the cold heat medium are not mixed due to the action of the second heat medium passage switching devices 22 and the first heat medium passage switching devices 23, and are introduced into a use side heat exchanger 26 having a heating load and a use side heat exchanger 26 having a cooling load, respectively. In the pipes 5 of the use side heat exchangers 26, the heat medium flows in the direction from the first heat medium passage switching devices 23 to the second heat medium passage switching devices 22 through the heat medium flow control devices 25 on both the heating side and the cooling side. Further, the air conditioning load required for the indoor space 7 can be compensated for by performing control to maintain the differences between the temperature detected by the temperature sensor 31*b* and the temperatures detected by the temperature sensors 34 on the heating side or between the temperatures detected by the temperature sensors 34 and the temperature detected by the temperature sensor 31*a* on the cooling side at a target value.

As described above, in both the heat exchanger related to heat medium 15*a* serving as a cooler and the heat exchanger related to heat medium 15*b* serving as a heater, the refrigerant and the heat medium are in counter flow. Flowing of the refrigerant and the heat medium in a counter-flow manner provides high heat exchange efficiency and improves COP.

Further, if a plate-type heat exchanger is used as the heat exchanger related to heat medium 15*a* serving as a cooler, flowing of the evaporation-side refrigerant from below to above in the manner illustrated in the drawing causes the evaporated gaseous refrigerant to move upward due to the buoyant force effect, yielding a reduction in the power of the compressor and appropriate distribution of the refrigerant. If a plate-type heat exchanger is used as the heat exchanger related to heat medium 15*a* serving as a cooler, furthermore, flowing of the heat medium from above to below in the manner illustrated in the drawing causes the chilled heat medium to sink due to the gravitational effect, yielding a reduction in the power of the pump, which is efficient.

Further, if a plate-type heat exchanger is used as the heat exchanger related to heat medium 15*b* serving as a heater, flowing of the condensing-side refrigerant from above to below in the manner illustrated in the drawing causes the condensed liquid refrigerant to move downward due to the gravitational effect, yielding a reduction in the power of the compressor. If a plate-type heat exchanger is used as the heat exchanger related to heat medium 15*b* serving as a heater, furthermore, flowing of the heat medium from below to above in the manner illustrated in the drawing causes the warmed heat medium to float due to the buoyant force effect, yielding a reduction in the power of the pumps, which is efficient.

In the first heating main operation mode, since it is not necessary to cause the heat medium to flow to a use side heat exchanger 26 having no heat load (including that in a thermostat-off state), the corresponding one of the heat medium flow control devices 25 closes the passage to prevent the heat medium from flowing to the use side heat exchanger 26. In FIG. 12, the heat medium is caused to flow to the use side heat exchanger 26*a* and the use side heat exchanger 26*b* because heat load is present, whereas the use side heat exchanger 26*c* and the use side heat exchanger 26*d* have no heat load and the respectively associated heat medium flow control device 25*c* and heat medium flow control device 25*d* are fully closed. Once heat load is generated in the use side heat exchanger 26*c* or the use side heat exchanger 26*d*, the heat medium flow control device 25*c* or the heat medium flow control device 25*d* may be opened to allow the heat medium to circulate therein.

[Second Heating Main Operation Mode]

Figure 13:
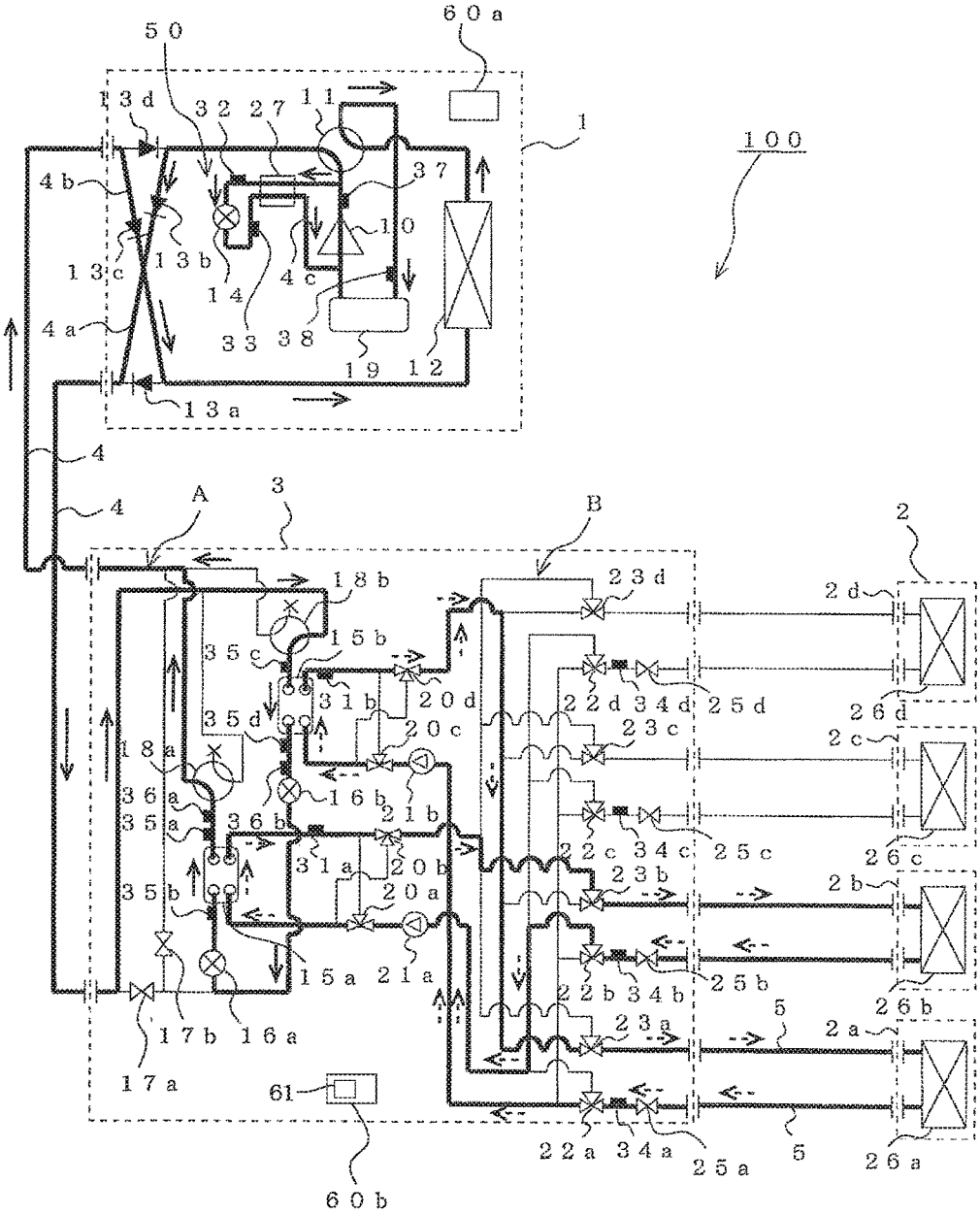
FIG. 13 is a system circuit diagram illustrating the flows of a refrigerant and a heat medium in a second heating main operation mode of the air-conditioning apparatus according to Embodiment of the present invention.

FIG. 13 is a system circuit diagram illustrating the flows of the refrigerant and the heat medium in the second heating main operation mode of the air-conditioning apparatus according to Embodiment of the present invention. Referring to FIG. 13, a description will be given of the second heating main operation mode, taking an example where a heating load is generated in the use side heat exchanger 26*a* and a cooling load is generated in the use side heat exchanger 26*b*. In FIG. 13, pipes indicated by thick lines represent pipes through which the refrigerant and the heat medium circulate. In FIG. 13, furthermore, the direction of the flow of the refrigerant is indicated by solid line arrows, and the direction of the flow of the heat medium is indicated by broken line arrows. The second heating main operation mode is used when there is a possibility of freezing of the heat medium in the heat exchanger related to heat medium 15*a*.

Here, the determination as to whether or not there is a possibility of freezing of the heat medium in the heat exchanger related to heat medium 15*a* may be performed, for example, as follows. That is, if at least one of the temperatures detected by the temperature sensor 35*a* and the temperature sensor 35*b* is less than or equal to the first set temperature (for example, −3 degrees C.) or at least one of the temperatures detected by the temperature sensor 34*b* and the temperature sensor 31*a* is less than or equal to the second set temperature (for example, 4 degrees C.), the freezing determination unit in the controller 60*b* determines that there is a possibility of freezing of the heat medium in the heat exchanger related to heat medium 15*a*. Note that a temperature sensor (fifth temperature detection device) may be provided, for example, in the vicinity of the heat source side heat exchanger 12, and it may be determined that there is a possibility of freezing of the heat medium in the heat exchanger related to heat medium 15*a* if the ambient air temperature around the heat source side heat exchanger 12 is less than a third set temperature (for example, 0 degrees C.).

In the second heating main operation mode, the flow of the refrigerant in the refrigerant circuit A is the same as that in the first heating main operation mode. Further, the flow of the heat medium in the heat medium circuit B is the same as that in the first heating main operation mode, except the flow of the heat medium around the heat exchangers related to heat medium 15*a* and 15*b*. Thus, a description will be given of only a portion of the flow of the heat medium different from that in the first heating main operation mode.

The heat medium pressurized by and flowing out of the pump 21*b* flows into the heat exchanger related to heat medium 15*b* from the lower portion of the drawing through the heat medium passage reversing device 20*c*, and is warmed by the refrigerant flowing through the heat exchanger related to heat medium 15*b*. The warmed heat medium flows out of the heat exchanger related to heat medium 15*b* from the upper portion of the drawing, and flows through the heat medium passage reversing device 20*d*, reaching the first heat medium passage switching device 23*a*. That is, the refrigerant and the heat medium, which flow through the heat exchanger related to heat medium 15*b*, are in counter flow. The heat medium pressurized by and flowing out of the pump 21*a* flows into the heat exchanger related to heat medium 15*a* from the lower portion of the drawing through the heat medium passage reversing device 20*a*, and is chilled by the refrigerant flowing through the heat exchanger related to heat medium 15*a*. The chilled heat medium flows out of the heat exchanger related to heat medium 15*a* from the upper portion of the drawing, and flows through the heat medium passage reversing device 20*b*, reaching the first heat medium passage switching device 23*b*. That is, the refrigerant and the heat medium, which flow through the heat exchanger related to heat medium 15*a*, are in parallel flow. The hot heat medium and the cold heat medium are not mixed due to the action of the second heat medium passage switching devices 22 and the first heat medium passage switching devices 23, and are introduced into a use side heat exchanger 26 having the heating load and a use side heat exchanger 26 having the cooling load, respectively.

As described above, in the heat exchanger related to heat medium 15*b* serving as a heater, the refrigerant flows from the upper portion of the drawing to the lower portion of the drawing, and the heat medium flows from the lower portion of the drawing to the upper portion of the drawing, where the refrigerant and the heat medium are in counter flow. Flowing of the refrigerant and the heat medium in a counter-flow manner provides high heat exchange efficiency and improves COP. Further, in the heat exchanger related to heat medium 15*a* serving as a cooler, the refrigerant flows from the lower portion of the drawing to the upper portion of the drawing, and the heat medium flows from the lower portion of the drawing to the upper portion of the drawing, where the refrigerant and the heat medium are in parallel flow. Flowing of the refrigerant and the heat medium in a parallel-flow manner does not provide high heat exchange efficiency. In the heat exchanger related to heat medium 15*a*, on the contrary, a low-temperature heat medium and a high-temperature refrigerant undergo heat exchange on the outlet side, whereas a high-temperature heat medium and a low-temperature refrigerant undergo heat exchange on the inlet side, resulting in freezing of the heat medium being less likely to occur and realizing safe operation.

[Refrigerant Pipes 4]

As described above, the air-conditioning apparatus 100 according to Embodiment has several operation modes. In these operation modes, a refrigerant flows through the pipes 4 connecting the outdoor unit 1 and the heat medium relay unit 3.

[Pipes 5]

In the several operation modes of the air-conditioning apparatus 100 according to Embodiment, a heat medium such as water or antifreeze flows through the pipes 5 connecting the heat medium relay unit 3 and the indoor units 2.

[Water Temperature Difference Control in Heat Exchanger Related to Heat Medium 15]

Next, water temperature difference control in the heat exchangers related to heat medium 15 in the case of using a non-azeotropic refrigerant mixture will be described in detail.

Figure 6:
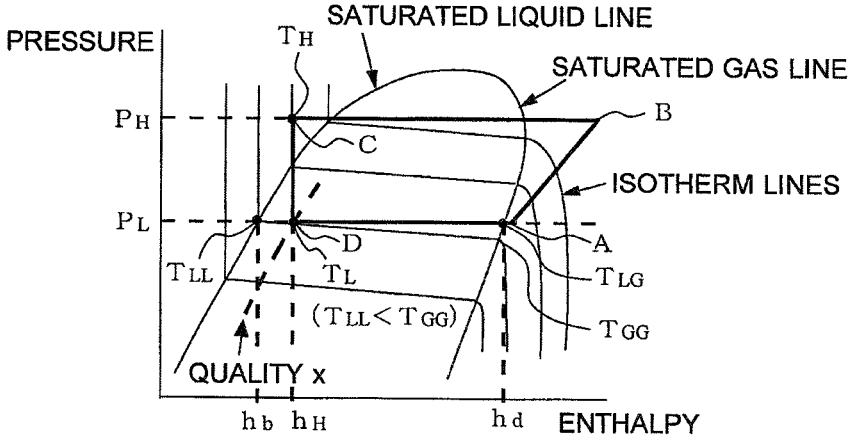
FIG. 6 is a P-h diagram for the case where the non-azeotropic refrigerant according to Embodiment of the present invention is in the state of certain circulation compositions.

In FIG. 6, described previously, the low-temperature and low-pressure gaseous refrigerant (point A) sucked into the compressor 10 is compressed into a high-temperature and high-pressure gaseous refrigerant (point B), and flows into a heat exchanger operating as a condenser (the heat source side heat exchanger 12 or the heat exchanger related to heat medium 15*a* or/and the heat exchanger related to heat medium 15*b*). The high-temperature and high-pressure gaseous refrigerant (point B) flowing into the heat exchanger operating as a condenser is condensed into a high-temperature and high-pressure liquid refrigerant (point C), and flows into the expansion device 16*a* or the expansion device 16*b*. The high-temperature and high-pressure liquid refrigerant (point C) flowing into the expansion device 16*a* or the expansion device 16*b* is expanded into a low-temperature and low-pressure two-phase refrigerant (point D), and flows into a heat exchanger operating as an evaporator (the heat source side heat exchanger 12 or the heat exchanger related to heat medium 15*a* or/and the heat exchanger related to heat medium 15*b*). The low-temperature and low-pressure two-phase refrigerant (point D) flowing into the heat exchanger operating as an evaporator is evaporated into a low-temperature and low-pressure gaseous refrigerant (point A), and is sucked into the compressor 10. For a non-azeotropic refrigerant mixture, there is a temperature difference between the temperature of the saturated gas refrigerant and the temperature of the saturated liquid refrigerant at the same pressure. In a condenser, temperature decreases as quality decreases in the two-phase region (the proportion of the liquid refrigerant increases). In an evaporator, temperature increases as quality increases in the two-phase region (the proportion of the gaseous refrigerant increases).

The operation in this case will be described in detail with reference to FIGS. 14 and 15.

Figure 14:
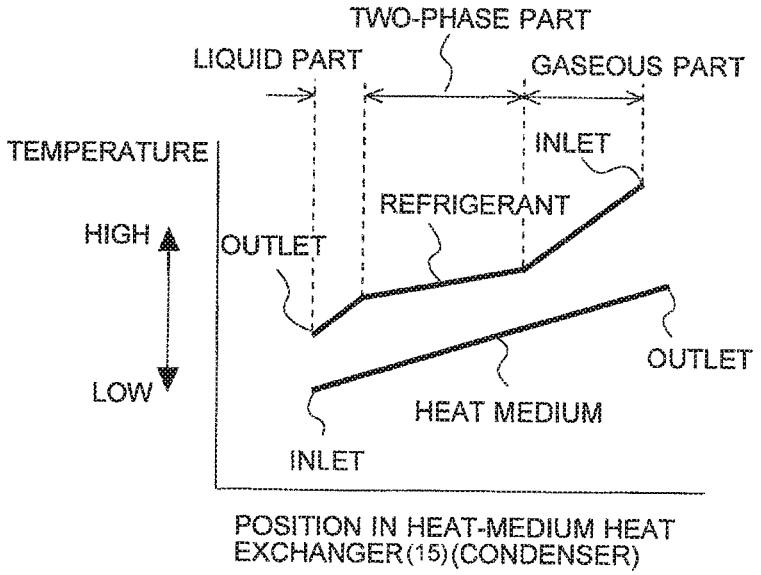
FIG. 14 is an explanatory diagram of operation when a heat exchanger related to heat medium according to Embodiment of the present invention is used as a condenser and when a refrigerant and a heat medium are in counter flow.

FIG. 14 is an explanatory diagram of operation when a heat exchanger related to heat medium according to Embodiment of the present invention is used as a condenser and when the refrigerant and the heat medium are in counter flow. FIG. 15 is an explanatory diagram of operation when a heat exchanger related to heat medium according to Embodiment of the present invention is used as an evaporator and when the refrigerant and the heat medium are in counter flow.

As illustrated in FIG. 14, when the heat exchanger related to heat medium 15 serves as a condenser, the refrigerant flows into the refrigerant flow passage of the heat exchanger related to heat medium 15 as a gaseous refrigerant, and radiates heat to the heat medium on the outlet side of the heat medium passage of the heat exchanger related to heat medium 15 to reduce the temperature, so that the refrigerant is turned into a two-phase refrigerant. In the two-phase refrigerant, the proportion of the liquid refrigerant increases while heat is radiated to the heat medium, and the temperature of the refrigerant decreases in accordance with the temperature difference between the saturated gas refrigerant temperature and the saturated liquid refrigerant temperature. After that, the resulting refrigerant is turned into a liquid refrigerant, and transfers heat to the heat medium on the inlet side of the heat medium passage of the heat exchanger related to heat medium 15, resulting in a further decrease in the temperature of the refrigerant. The refrigerant and the heat medium flow in a counter-flow manner (in opposing directions), and the temperature of the heat medium increases in the direction from the inlet side to the outlet side.

Next, a description will be given of a case where the heat exchanger related to heat medium 15*a* or/and the heat exchanger related to heat medium 15*b* is used as an evaporator. As illustrated in FIG. 15, when the heat exchanger related to heat medium 15 serves as an evaporator, the refrigerant flows into the refrigerant flow passage of the heat exchanger related to heat medium 15 in a two-phase state, and absorbs heat from the heat medium on the outlet side of the heat medium passage of the heat exchanger related to heat medium 15, resulting in an increase in the proportion of the gaseous refrigerant. This two-phase refrigerant is such that the temperature of the refrigerant increases in accordance with the temperature difference between the temperature of the refrigerant in the two-phase state at the inlet of the evaporator and the temperature of the saturated gas refrigerant. Finally, the two-phase refrigerant absorbs heat from the heat medium on the inlet side of the heat medium passage of the heat exchanger related to heat medium 15, and is turned into a gaseous refrigerant. If the refrigerant and the heat medium flow in a counter-flow manner (in opposing directions), the temperature of the heat medium decreases in the direction from the inlet side to the outlet side.

Figure 15:
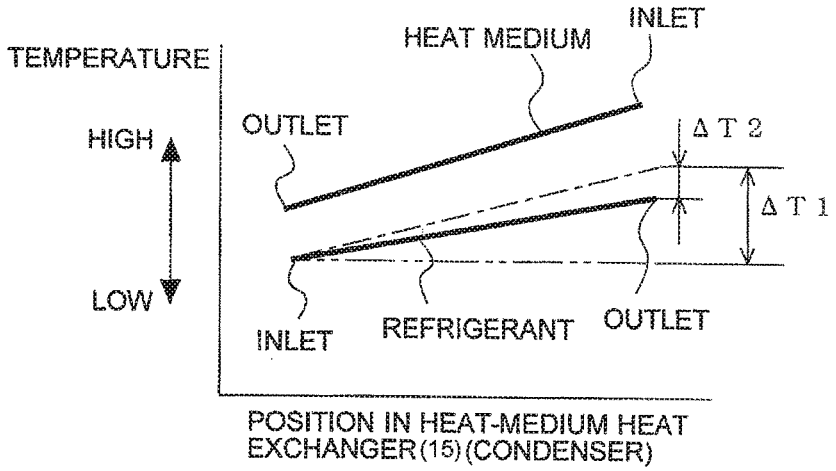
FIG. 15 is an explanatory diagram of operation when a heat exchanger related to heat medium according to Embodiment of the present invention is used as an evaporator and when a refrigerant and a heat medium are in counter flow.

At this time, if there is absolutely no pressure loss of the refrigerant in the refrigerant flow passage of the heat exchanger related to heat medium 15, the temperature of the refrigerant increases along a line indicated by a one-dot chain line in FIG. 15, where the temperature of the refrigerant increases by an amount corresponding to the temperature difference between the temperature of the refrigerant in the two-phase state at the inlet of the evaporator and the saturated gas refrigerant temperature at the same pressure. In FIG. 15, the ideal amount of increase in temperature is indicated by $\Delta T1$. In actuality, however, because of the presence of a pressure loss in the refrigerant flow passage of the heat exchanger related to heat medium 15, the increase in the temperature of the refrigerant flowing from the inlet to outlet of the heat exchanger related to heat medium 15 is slightly smaller than the increase in temperature indicated by the one-dot chain line in FIG. 15. In FIG. 15, the amount of decrease in the temperature of the refrigerant due to the pressure loss is indicated by $\Delta T2$. If the amount of decrease $\Delta T2$ in temperature due to the pressure loss is sufficiently smaller than the amount of increase in temperature $\Delta T1$ due to the temperature glide of the refrigerant, the temperature difference between the refrigerant and the heat medium can be reduced at individual positions in the heat exchanger related to heat medium 15, compared to the case where a single refrigerant, which undergoes substantially no temperature change in the two-phase state, or a near-azeotropic refrigerant is used, improving heat exchange efficiency.

In FIG. 15, it is assumed that the refrigerant flows out of the heat exchanger related to heat medium 15 in a saturated gas state, that is, the degree of superheating is zero. In addition, the refrigerant temperature in an intermediate portion of the heat exchanger related to heat medium 15 is higher than the refrigerant temperature at the inlet of the heat exchanger related to heat medium 15 regardless of the degree of heating.

Figure 16:
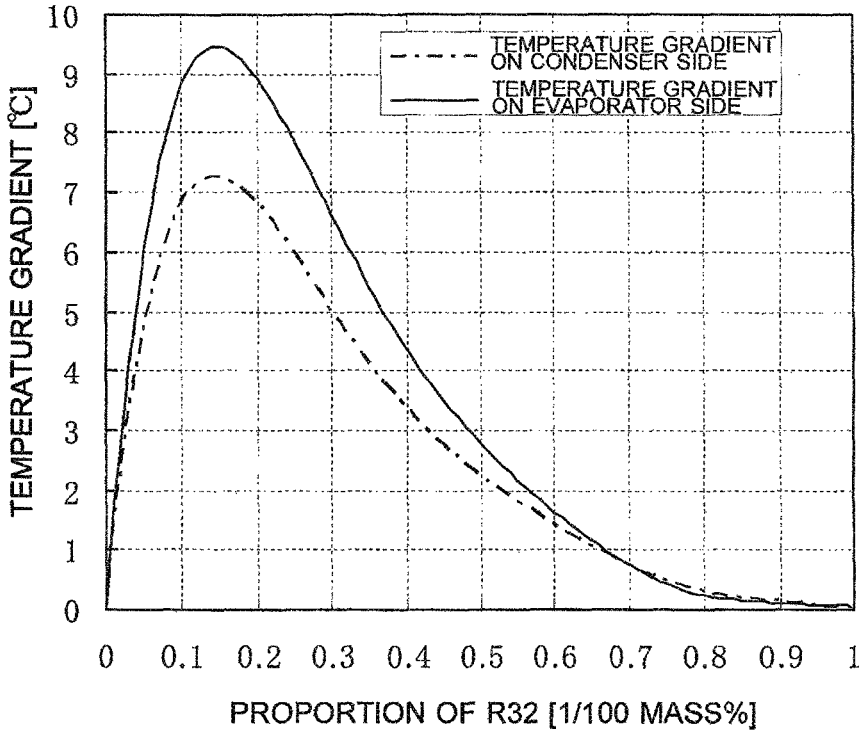
FIG. 16 is a diagram illustrating temperature glides of a non-azeotropic refrigerant mixture in the air-conditioning apparatus according to Embodiment of the present invention.

FIG. 16 is a diagram illustrating temperature glides on the condenser side and the evaporator side when the mixture ratio (mass %) of R32 in a refrigerant mixture of R32 and HFO1234yf varies. The region where the proportion of R32 ranges from 3 mass % to 45 mass % is a region having the largest temperature glide, and the temperature glide on the evaporation side ranges from approximately 3.5 [degrees C.] to 9.5 [degrees C.]. If the proportion of R32 is in this region, the temperature glide is large. Thus, the temperature glide is still large even if a temperature drop occurs due to a slightly large pressure loss.

As described above, when the heat exchanger related to heat medium 15 serves as an evaporator (cooler), heat exchange efficiency can be improved by controlling the temperature difference of the heat medium flowing through the heat exchanger related to heat medium 15 in accordance with the temperature glide based on the circulation compositions of the refrigerant. In a non-azeotropic refrigerant mixture, however, the circulation compositions of the refrigerant vary depending on the operation state such as an excess amount of refrigerant. Accordingly, the control target value (first target value) of the temperature difference of the heat medium flowing through the heat exchanger related to heat medium 15 (that is, the temperature difference between the temperature sensor 31 and the temperature sensor 34) is not fixed, where an initial value is stored in advance, but varies in accordance with the time-varying operation state, and may be reset. Specifically, the circulation compositions of the refrigerant may be calculated using the refrigerant circulation composition detection device 50, the operation of which has been described previously, and the control target value of the temperature difference of the heat medium flowing through the heat exchanger related to heat medium 15 may be set in accordance with the calculated circulation compositions (or the temperature glide of the refrigerant calculated from the circulation compositions).

When the heat exchanger related to heat medium 15 serves as an evaporator, a two-phase refrigerant having a mixture of a liquid refrigerant and a gaseous refrigerant flows into the refrigerant flow passage of the heat exchanger related to heat medium 15, and the temperature of the refrigerant increases in accordance with an increase in gaseous components during the subsequent evaporation process. At this time, a pressure loss occurs in the refrigerant flowing through the refrigerant flow passage of the heat exchanger related to heat medium 15, and a reduction in temperature by the amount corresponding to the pressure loss occurs. In accordance with the factors described above, the temperature difference between the refrigerant on the outlet side of the heat exchanger related to heat medium 15 and the refrigerant on the inlet side of the inlet-side heat exchanger related to heat medium 15 is determined. The temperature difference between the refrigerant on the outlet side of the heat exchanger related to heat medium 15 and the refrigerant on the inlet side of the heat exchanger related to heat medium 15 is assumed to be, for example, 5 degrees C. If the pressure loss in the refrigerant is excessively high, the performance of the heat exchanger related to heat medium 15 deteriorates. Thus, the heat exchanger related to heat medium 15 according to Embodiment is configured such that the reduction in temperature due to the pressure loss is appropriately 1 to 2 degrees C. Further, the temperature of the heat medium flowing through the heat exchanger related to heat medium 15 is higher than that of the refrigerant, and the temperature difference (average temperature difference) between the heat medium and the refrigerant is approximately 3 to 7 degrees C. In consideration of the foregoing, the control target value of the difference between the inlet and outlet temperatures of the heat medium flowing through the heat exchanger related to heat medium 15 is set to a value substantially equal to the temperature difference between the inlet and outlet temperatures of the refrigerant in the heat exchanger related to heat medium 15, providing high heat exchange efficiency. If the difference between the inlet and outlet temperatures of the refrigerant in the heat exchanger related to heat medium 15 is 5 degrees C., the control target value of the difference between the inlet and outlet temperatures of the heat medium flowing through the heat exchanger related to heat medium 15 may be set to 3 to 7 degrees C.

A pressure loss in the refrigerant is predictable to some extent based on the operation state. Thus, when the heat exchanger related to heat medium 15 serves as an evaporator, for example, if the calculated temperature glide of the refrigerant is 5 degrees C., settings may be made such that the control target value of the heat medium is set to a value in the range from 5 degrees C., which is substantially the same as the calculated temperature glide of the refrigerant, to a slightly larger value, or 7 degrees C., for a significantly small pressure loss in the refrigerant in the heat exchanger related to heat medium 15, and the control target value may be set to 4 degrees C., 3 degrees C., or the like, which is smaller than the calculated temperature glide of the refrigerant for a large pressure loss to some extent. Further, for example, if the calculated temperature glide of the refrigerant is, for example, 7 degrees C., settings may be made such that the control target value of the heat medium is set to a value in the range from 7 degrees C. to 9 degrees C. for a significantly small pressure loss, and the control target value is set to 6 degrees C. or 5 degrees C. for a large pressure loss to some extent. This control is automatically performed by the controller 60*b* on the basis of the circulation compositions calculated by the controller 60*a*.

Here, (1) when the heat exchanger related to heat medium 15 serves as a condenser and (2) when the heat exchanger related to heat medium 15 serves as an evaporator and the temperature of the heat medium in the heat medium flow passage and the temperature of the refrigerant in the refrigerant flow passage are higher than the set temperatures described above, flowing of the refrigerant and the heat medium, which flow through the heat exchanger related to heat medium 15, in a counter-flow manner provides high heat exchange efficiency of the heat exchanger related to heat medium 15. In contrast, (3) when the heat exchanger related to heat medium 15 serves as an evaporator and the temperature of the heat medium in the heat medium flow passage or/and the temperature of the refrigerant in the refrigerant flow passage is less than or equal to the set temperatures described above, flowing of the heat medium and the refrigerant in a counter-flow manner in the heat exchanger related to heat medium 15 may cause the heat medium to be frozen in the heat medium passage, and the heat exchanger related to heat medium 15 can be broken.

Accordingly, if there is a concern that the heat medium will be frozen, in the air-conditioning apparatus 100 according to Embodiment, the passage of the heat medium that is to flow into the heat exchanger related to heat medium 15 serving as an evaporator is reversed so that the flows of the heat medium and the refrigerant are in parallel flow.

Figure 17:
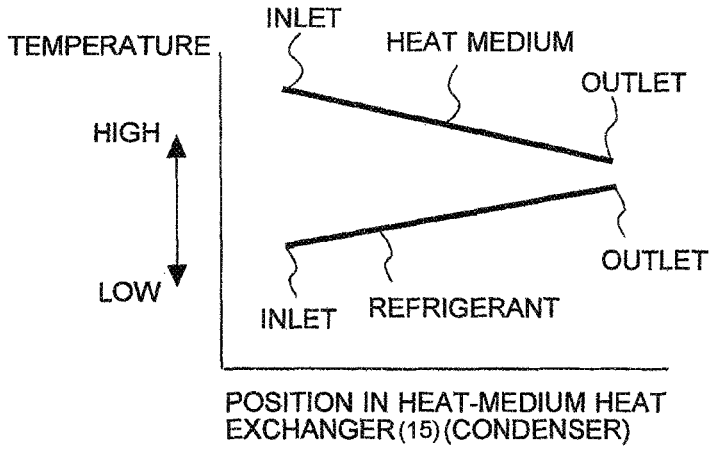
FIG. 17 is an explanatory diagram of operation when a heat exchanger related to heat medium according to Embodiment of the present invention is used as an evaporator and when a refrigerant and a heat medium are in parallel flow.

FIG. 17 is an explanatory diagram of operation when a heat exchanger related to heat medium according to Embodiment of the present invention is used as an evaporator and when the refrigerant and the heat medium are in parallel flow.

When the heat exchanger related to heat medium 15 serves as an evaporator, flowing of the refrigerant and the heat medium in a parallel-flow manner increases the temperature of a non-azeotropic refrigerant mixture in accordance with a two-phase change in the direction from the inlet to the outlet. Then, the heat medium is cooled by the refrigerant, so that the temperature thereof decreases in the direction from the inlet to the outlet. That is, a high-temperature heat medium and a low-temperature refrigerant heat exchange on the inlet side of the heat exchanger related to heat medium 15, and a low-temperature heat medium and a high-temperature refrigerant heat exchange on the outlet side of the heat exchanger related to heat medium 15. The heat medium is more prone to freezing when the temperature is low; nonetheless, a low-temperature heat medium is less likely to be frozen because it undergoes heat exchange with a high-temperature refrigerant.

The difference between the inlet and outlet temperatures of the refrigerant in the heat exchanger related to heat medium 15 may be handled by adjusting the flow rate of the heat medium transmitted through the pump 21. One method for reducing the flow rate of the flow transmitted through the pump 21 is to reduce the frequency to reduce the flow rate when the pump 21 is driven by a brushless DC inverter, an AC inverter, or the like. When the pump 21 is not of an inverter type, the voltage to be applied to the pump 21 may be reduced by switching a resistor or any other method. Alternatively, a valve whose opening area for a passage is variable may be provided on the suction side or discharge side of the pump 21, and the passage area may be reduced to reduce the flow rate of the flow to the pump 21.

In the air-conditioning apparatus 100 having the configuration described above, when the heat exchanger related to heat medium 15 is used as an evaporator, if there is a possibility of freezing of the heat medium, the refrigerant and the heat medium in the heat exchanger related to heat medium 15 are caused to flow in parallel, thereby preventing freezing of the heat medium and providing safe operation.

Further, in the heating main operation, if the ambient air temperature around the heat source side heat exchanger 12 is low, the pressure of the refrigerant in the heat exchanger related to heat medium 15*a* serving as an evaporator decreases, reducing the temperature. In contrast, the air-conditioning apparatus 100 according to Embodiment operates the second heating main operation mode (that is, the refrigerant and the heat medium, which flow through the heat exchanger related to heat medium 15*a*, are in parallel flow) when the ambient air temperature is less than or equal to a set temperature (for example, less than or equal to 0 degrees C.), thereby preventing freezing of the heat medium and providing safe operation.

If the refrigerant and the heat medium, which flow through the heat exchanger related to heat medium 15, are in parallel flow, the set temperature of the heat medium (set temperatures of the temperature sensor 31 and the temperature sensor 34) used as a reference for the freezing determination unit to determine whether there is a possibility of freezing of the heat medium may be set to a fourth set temperature lower than the second set temperature. Further, the control target value of the temperature difference of the heat medium flowing through the heat exchanger related to heat medium 15 (that is, the temperature difference between the temperature sensor 31 and the temperature sensor 34) may be set to a second target value (for example, 0 degrees C.) lower than the first target value. This can increase the flow rate of the heat medium flowing through the heat medium flow passage of the heat exchanger related to heat medium 15, and can prevent the outlet temperature of the heat medium from decreasing, thereby more reliably preventing freezing of the heat medium.

Further, when the heat exchanger related to heat medium 15 is used as a condenser, the regions of the heated gaseous refrigerant and the subcooled-liquid refrigerant in the heat exchanger related to heat medium 15 enlarge to some extent. Thus, the control target value of the temperature difference of the heat medium may be set to a value larger than the calculated temperature glide of the refrigerant. For example, if the calculated temperature glide of the refrigerant is 5 degrees C., the control target value of the temperature difference of the heat medium may be set to a value larger than 5 degrees C., such as 7 degrees C.

The temperature difference between the temperature sensor 31 and the temperature sensor 34 is referred to here as a temperature difference of the heat medium flowing through the heat exchanger related to heat medium 15, or may be referred to as an inlet/outlet temperature difference of the use side heat exchanger 26, where both temperature differences are the same unless heat penetration into the pipe 5, or the like occurs. Alternatively, another temperature sensor may be installed on the inlet side of the use side heat exchanger 26 to control the temperature difference between the temperature detected thereby and that of the temperature sensor 34.

Further, the air-conditioning apparatus 100 according to Embodiment is designed such that if only heating load or cooling load is generated in the use side heat exchangers 26, the opening degrees of the associated second heat medium passage switching devices 22 and the associated first heat medium passage switching devices 23 are set to an intermediate opening degree to allow the heat medium to flow through both the heat exchanger related to heat medium 15*a* and the heat exchanger related to heat medium 15*b*. Thus, both the heat exchanger related to heat medium 15*a* and the heat exchanger related to heat medium 15*b* can be used for the heating operation or the cooling operation. This can increase the heat transfer area, providing an efficient heating operation or cooling operation.

Further, if both heating load and cooling load are generated in the use side heat exchangers 26, the second heat medium passage switching device 22 and the first heat medium passage switching device 23, which are associated with the use side heat exchanger 26 currently in the heating operation, are switched to the passage connected to the heat exchanger related to heat medium 15*b* for use in heating, and the second heat medium passage switching device 22 and the first heat medium passage switching device 23, which are associated with the use side heat exchanger 26 currently in the cooling operation, are switched to the passage connected to the heat exchanger related to heat medium 15*a* for use in cooling. This enables the individual indoor units 2 to freely perform the heating operation and the cooling operation.

In Embodiment, both the second heat medium passage switching devices 22 and the first heat medium passage switching devices 23 are provided. Alternatively, only the first heat medium passage switching devices 23 may allow the individual indoor units 2 to freely perform the heating operation and the cooling operation (to perform a simultaneous cooling and heating operation). At this time, the heat media flowing out of the individual indoor units 2 merge on the way (if the second heat medium passage switching devices 22 are provided, at the positions where the second heat medium passage switching devices 22 are located). That is, a cold heat medium (for example, 10 degrees C.) flowing out of the use side heat exchanger 26 on the cooling side and a hot heat medium (for example, 40 degrees C.) flowing out of the use side heat exchanger 26 on the heating side are caused to merge into an intermediate-temperature heat medium (for example, 25 degrees C.), and the intermediate-temperature heat medium flows into the heat exchangers related to heat medium 15*a* and 15*b*. Then, the heat exchanger related to heat medium 15*a* chills the intermediate-temperature heat medium to generate a cold heat medium (for example, 5 degrees C.), and the heat exchanger related to heat medium 15*b* chills the intermediate-temperature heat medium to generate a hot heat medium (for example, 45 degrees C.). Thereafter, due to the effect of the first heat medium passage switching devices 23, the cold heat medium flows into the use side heat exchanger 26 on the cooling side and the hot heat medium flows into the use side heat exchanger 26 on the heating side, which are used for the cooling operation and the heating operation, respectively. In this case, since the cold heat medium and the hot heat medium merge into an intermediate-temperature heat medium on the outlet side of the use side heat exchangers 26, waste occurs in terms of the amount of heat. Therefore, both the second heat medium passage switching devices 22 and the first heat medium passage switching devices 23 allow a more efficient operation, whereas only the first heat medium passage switching devices 23 allow a cooling and heating mixed operation at low cost. Note that a structure in which only the second heat medium passage switching devices 22 are provided does not allow a cooling and heating mixed operation.

Further, each of the second heat medium passage switching devices 22 and the first heat medium passage switching devices 23 described in Embodiment may be designed to switch between passages, such as a device capable of switching between three-way passages, such as a three-way valve, or a device formed by combining two devices, each configured to open and close two-way passages, such as opening and closing valves. Further, each of the second heat medium passage switching devices 22 and the first heat medium passage switching devices 23 may be a device capable of changing the flow rates of three-way passages, such as a stepping-motor-driven mixing valve, or may be implemented by, for example, combining two devices each capable of changing the flow rates of two-way passages, such as electronic expansion valves. In this case, water hammer caused by a sudden opening and closing of a passage can also be prevented. In Embodiment, furthermore, the description has been made taking an example where each of the heat medium flow control devices 25 is a two-way valve. Alternatively, each of the heat medium flow control devices 25 may be a control valve having three-way passages, and may be disposed together with bypass pipes that bypass the use side heat exchangers 26.

In addition, each of the heat medium flow control devices 25 may be implemented as an stepping-motor-driven device capable of controlling the flow rate of the flow through a passage, or may be a two-way valve or a three-way valve whose one end is closed. Alternatively, each of the heat medium flow control devices 25 may be implemented as a device that opens and closes two-way passages, such as an opening and closing valve, which is repeatedly turned on and off to control an average flow rate.

Figure 18:
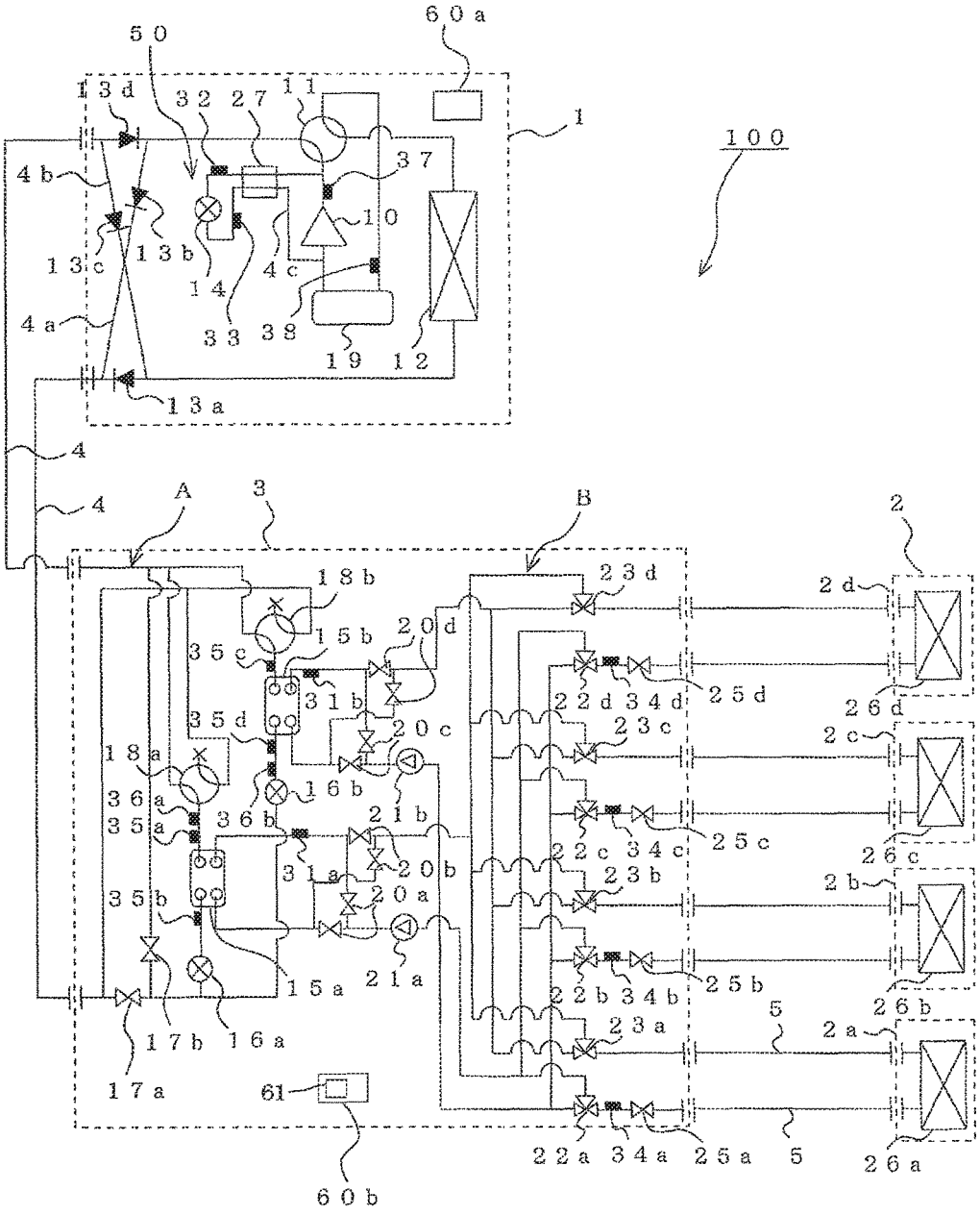
FIG. 18 is a schematic circuit configuration diagram illustrating another example circuit configuration of the air-conditioning apparatus according to Embodiment of the present invention.

Furthermore, each of the heat medium passage reversing devices 20 may not only be a device capable of switching between three-way passages, such a three-way valve, but also be implemented by combining two devices each configured to open and close two-way passages, such as opening and closing valves as illustrated in FIG. 18. Any device capable of switching between passages may be used. Alternatively, a device capable of changing the flow rates for three-way passages, such as a stepping-motor-driven mixing valve, may be used, or two devices each capable of changing the flow rates for two-way passages, such as electronic expansion valves, may be used in combination.

Further, each of the second refrigerant passage switching devices 18 is illustrated as a four-way valve, but is not limited thereto. Each of the second refrigerant passage switching device 18 may be configured by using a plurality of two-way passage switching valves or three-way passage switching valves so that the refrigerant flows in the same manner.

The air-conditioning apparatus 100 according to Embodiment has been described as being capable of performing a cooling and heating mixed operation, but is not limited thereto. The air-conditioning apparatus 100, which is configured to include a single heat exchanger related to heat medium 15 and a single expansion device 16, to which a plurality of use side heat exchangers 26 and a plurality of heat medium flow control devices 25 are connected in parallel, and configured to perform only either the cooling operation or the heating operation, would achieve similar advantages.

Further, there is of course no problem if a plurality of devices designed to operate in the same manner are disposed as the heat exchangers related to heat media 15 and the expansion devices 16. Furthermore, the description has been made taking an example where the heat medium flow control devices 25 are incorporated in the heat medium relay unit 3, but Embodiment is not limited thereto. The heat medium flow control devices 25 may be incorporated in the indoor units 2, or may be configured separately from the heat medium relay unit 3 and the indoor units 2.

Further, the heat medium is not limited to water, and may be implemented using, for example, brine (antifreeze), a liquid mixture of brine and water, a liquid mixture of water and anti-corrosive additive, or the like.

Further, each of the heat source side heat exchanger 12 and the use side heat exchangers 26*a* to 26*d* is generally equipped with an air-sending device, and the blowing of air often facilitates condensation or evaporation, but is not limited thereto. For example, each of the use side heat exchangers 26*a* to 26*d* may be implemented using a device that utilizes radiation, like a panel heater, and the heat source side heat exchanger 12 may be of a water-cooled type that causes heat to move by water or antifreeze. Any structure capable of radiating heat or absorbing heat may be used.

Further, while the description has been made with reference to FIG. 2, taking an example of the four use side heat exchangers 26*a* to 26*d*, any number of use side heat exchangers may be connected.

Further, the description has been made with reference to FIG. 2, taking an example of the two heat exchangers related to heat medium 15*a* and 15*b*, but, of course, Embodiment is not limited thereto. Any number of heat exchangers related to heat medium which are configured to be capable of cooling or/and heating a heat medium may be installed.

Further, the pumps 21*a* and 21*b* are not necessarily single ones, and each of them may be implemented by arranging a plurality of small-capacity pumps in parallel.

REFERENCE SIGNS LIST

1 outdoor unit (heat source unit), 2 (2*a*, 2*b*, 2*c*, 2*d*) indoor unit, 3 heat medium relay unit, 4 refrigerant pipe, 4*a* first connecting pipe, 4*b* second connecting pipe, 4*c* high-low pressure bypass pipe, 5 pipe, 6 outdoor space, 7 indoor space, 8 space, 9 structure, 10 compressor, 11 first refrigerant passage switching device (four-way valve), 12 heat source side heat exchanger, 13*a*, 13*b*, 13*c*, 13*d* check valve, 14 expansion device, 15 (15*a*, 15*b*) heat exchanger related to heat medium, 16 (16*a*, 16*b*) expansion device, 17 (17*a*, 17*b*) opening and closing device, 18 (18*a*, 18*b*) second refrigerant passage switching device, 19 accumulator, 20 (20*a*, 20*b*, 20*c*, 20*d*) heat medium passage reversing device, 21 (21*a*, 21*b*) pump (heat medium sending device), 22 (22*a*, 22*b*, 22*c*, 22*d*) second heat medium passage switching device, 23 (23*a*, 23*b*, 23*c*, 23*d*) first heat medium passage switching device, 25 (25*a*, 25*b*, 25*c*, 25*d*) heat medium flow control device, 26 (26*a*, 26*b*, 26*c*, 26*d*) use side heat exchanger, 27 refrigerant-refrigerant heat exchanger, 31 (31*a*, 31*b*) temperature sensor, 32 high-pressure side refrigerant temperature detection device, 33 low-pressure side refrigerant temperature detection device, 34 (34*a*, 34*b*, 34*c*, 34*d*) temperature sensor, 35 (35*a*, 35*b*, 35*c*, 35*d*) temperature sensor, 36 (36*a*, 36*b*) pressure sensor, 37 high-pressure side pressure detection device, 38 low-pressure side pressure detection device, 50 refrigerant circulation composition detection device, 60 (60*a*, 60*b*) controller, 100 air-conditioning apparatus, A refrigerant circuit, B heat medium circuit.

The invention claimed is:

1. An air-conditioning apparatus comprising:

a refrigerant circuit in which a compressor, a refrigerant passage switching device that switches a passage of a refrigerant discharged from the compressor, a first heat exchanger, a first expansion device, and a refrigerant flow passage of a second heat exchanger are connected via a refrigerant pipe through which the refrigerant is distributed;

a heat transfer medium circuit in which a heat transfer medium flow passage of the second heat exchanger and a heat transfer medium sending device are connected via a heat transfer medium pipe through which a heat transfer medium is distributed, and to which a use side heat exchanger is connected;

a heat transfer medium passage reversing device that is disposed in the heat transfer medium circuit and that is configured to switch a direction of the heat transfer medium flowing through the heat transfer medium flow passage of the second heat exchanger between a normal direction and a reverse direction;

a controller configured to control the heat transfer medium passage reversing device to switch the direction of the heat transfer medium flowing through the heat transfer medium flow passage of the second heat exchanger; and a freezing determination processor configured to determine whether or not there is a possibility of freezing of the heat transfer medium flowing through the heat transfer medium flow passage of the second heat exchanger, wherein the refrigerant flowing through the refrigerant circuit is a non-azeotropic refrigerant mixture including a plurality of components and having a temperature glide between a saturated gas temperature and a saturated liquid temperature at the same pressure, and wherein in a condition where the second heat exchanger serves as a cooler that cools the heat transfer medium, the controller is configured to control the heat transfer medium passage reversing device so that, when the freezing determination processor determines that the heat transfer medium flowing through the heat transfer medium flow passage of the second heat exchanger will not be frozen, the refrigerant flowing through the refrigerant flow passage of the second heat exchanger and the heat transfer medium flowing through the heat transfer medium flow passage of the second heat exchanger are in counter flow, and control the heat transfer medium passage reversing device so that, when the freezing determination processor determines that there is a possibility of freezing of the heat transfer medium flowing through the heat transfer medium flow passage of the second heat exchanger, the refrigerant flowing through the refrigerant flow passage of the second heat exchanger and the heat transfer medium flowing through the heat transfer medium flow passage of the second heat exchanger are in parallel flow.

2. The air-conditioning apparatus of claim 1, further comprising:

at least one of a first temperature sensor disposed on one of an inlet side and an outlet side of the refrigerant flow passage of the second heat exchanger, a second temperature sensor disposed on the other of the inlet side and the outlet side of the refrigerant flow passage of the second heat exchanger, a third temperature sensor disposed on an inlet side of the heat transfer medium flow passage of the second heat exchanger or on an outlet side of the use side heat exchanger, a fourth temperature sensor disposed on an outlet side of the heat transfer medium flow passage of the second heat exchanger or on an inlet side of the use side heat exchanger, and a fifth temperature sensor configured to detect an ambient air temperature of the first heat exchanger, wherein the freezing determination processor is configured to determine that there is the possibility of freezing of the heat transfer medium flowing through the heat transfer medium flow passage of the second heat exchanger when at least one condition is established among: a case where a detection value of at least one of the first temperature sensor and the second temperature sensor is less than or equal to a first set temperature, a case where a detection value of at least one of the third temperature sensor and the fourth temperature sensor is less than or equal to a second set temperature, and a case where a detection value of the fifth temperature sensor is less than or equal to a third set temperature.

3. The air-conditioning apparatus of claim 2, wherein in a condition where the second heat exchanger serves as a cooler that cools the heat transfer medium, the controller is configured to set the first set temperature on the basis of the composition of the refrigerant or a temperature glide between a saturated gas temperature and a saturated liquid temperature at the same pressure of the refrigerant, which is calculated based on the composition.

4. The air-conditioning apparatus of claim 3, further comprising:

a refrigerant circulation composition sensor configured to detect a composition of the refrigerant that circulates the refrigerant circuit, wherein the refrigerant circulation composition sensor at least includes a low-pressure side pressure sensor configured to detect a low-pressure side pressure of the compressor, a high-low pressure bypass pipe that connects a discharge-side passage of the compressor and a suction-side passage of the compressor, a second expansion device disposed in the high-low pressure bypass pipe, a high-pressure side temperature sensor disposed in the high-low pressure bypass pipe on an inlet side of the second expansion device, a low-pressure side temperature sensor disposed in the high-low pressure bypass pipe on an outlet side of the second expansion device, and a refrigerant-refrigerant heat exchanger configured to cause heat exchange between refrigerants flowing through pipes located before and after the second expansion device, and wherein the controller is configured to calculate a composition of the refrigerant or the temperature glide of the refrigerant using at least the pressure detected by the low-pressure side pressure sensor, a temperature detected by the high-pressure side temperature sensor, and a temperature detected by the low-pressure side temperature sensor.

5. The air-conditioning apparatus of claim 1, wherein in a condition where the second heat exchanger serves as a heater that heats the heat transfer medium, the controller is configured to control the heat transfer medium passage reversing device so that the refrigerant flowing through the refrigerant flow passage of the second heat exchanger and the heat transfer medium flowing through the heat transfer medium flow passage of the second heat exchanger are in counter flow.

6. The air-conditioning apparatus of claim 1, further comprising:

a third temperature sensor disposed on the inlet side of the heat transfer medium flow passage of the second heat exchanger or on an outlet side of the use side heat exchanger; and a fourth temperature sensor disposed on the outlet side of the heat transfer medium flow passage of the second heat exchanger or on the inlet side of the use side heat exchanger, wherein the controller is configured to set a first target value on the basis of the composition of the refrigerant or the temperature glide between the saturated gas temperature and the saturated liquid temperature at the same pressure of the refrigerant, which is calculated based on the composition, the first target value being a control target value of a temperature difference between the third temperature sensor and the fourth sensor.

7. The air-conditioning apparatus of claim 6, wherein the controller includes a first controller and a second controller, wherein the compressor, the refrigerant passage switching device, the first heat exchanger, and the first controller are included in an outdoor unit, wherein the first expansion device, the second heat exchanger, the heat transfer medium sending device, and the second controller are included in a heat transfer medium relay unit, wherein the first controller and the second controller are connected via wire or wirelessly so as to be capable of communicating with each other, wherein the first controller is configured to transmit the composition of the refrigerant or the temperature glide between the saturated gas temperature and the saturated liquid temperature at the same pressure of the refrigerant, which is calculated based on the composition, to the second controller, and wherein the second controller is configured to set the control target value on the basis of the composition of the refrigerant or the temperature glide, which has been transmitted.

8. The air-conditioning apparatus of claim 7, further comprising:

a refrigerant circulation composition sensor configured to detect a composition of the refrigerant that circulates in the refrigerant circuit, wherein the refrigerant circulation composition sensor at least includes a low-pressure side pressure sensor configured to detect a low-pressure side pressure of the compressor, a high-low pressure bypass pipe connected between (1) a passage between a discharge side of the compressor and the refrigerant passage switching device, and (2) a passage between a suction side of the compressor and the refrigerant passage switching device, a second expansion device disposed in the high-low pressure bypass pipe, a high-pressure side temperature sensor disposed in the high-low pressure bypass pipe on an inlet side of the second expansion device, a low-pressure side temperature sensor disposed in the high-low pressure bypass pipe on an outlet side of the second expansion device, and a refrigerant-refrigerant heat exchanger configured to cause heat exchange between refrigerants flowing through pipes located before and after the second expansion device, and wherein the first controller is configured to calculate a composition of the refrigerant or the temperature glide of the refrigerant using at least the pressure detected by the low-pressure side pressure sensor, a temperature detected by the high-pressure side temperature sensor, and a temperature detected by the low-pressure side temperature sensor, and transmit the circulation composition of the refrigerant or the temperature glide of the refrigerant to the second controller.

9. The air-conditioning apparatus of claim 7, wherein the heat transfer medium passage reversing device is included in the heat transfer medium relay unit.

10. The air-conditioning apparatus of claim 6, wherein in a condition where the second heat exchanger serves as a cooler that cools the heat transfer medium and the refrigerant flowing through the refrigerant flow passage of the second heat exchanger and the heat transfer medium flowing through the heat transfer medium flow passage of the second heat exchanger are in parallel flow, if a detection value of the third temperature sensor or a detection value of the fourth sensor is less than or equal to a fourth set temperature, the controller sets the control target value of the temperature difference between the third temperature sensor and the fourth temperature sensor to a second target value lower than the first target value, instead of the first target value.

11. The air-conditioning apparatus of claim 6, wherein the control target value for the second heat exchanger or the use side heat exchanger when the second heat exchanger serves as a heater that heats the heat transfer medium is larger than the control target value for the second heat exchanger or the use side heat exchanger when the second heat exchanger serves as a cooler that cools the heat transfer medium.

12. The air-conditioning apparatus of claim 1, wherein the air-conditioning apparatus comprises a plurality of second heat exchangers, each being the second heat exchanger, and a plurality of heat transfer medium sending devices, each being the heat transfer medium sending device, wherein the air-conditioning apparatus further comprises first heat transfer medium passage switching devices each connected to a passage on an outlet side of one of the plurality of second heat exchangers, each of the first heat transfer medium passage switching devices configured to select one of the second heat exchangers which communicates with a passage on the inlet side of the use side heat exchanger, and wherein the air-conditioning apparatus further comprises second heat transfer medium passage switching devices each connected to the passage on the inlet side of one of the plurality of second heat exchangers, each of the second heat transfer medium passage switching devices configured to select one of the second heat exchangers which communicates with the passage on the outlet side of the use side heat exchanger.

13. The air-conditioning apparatus of claim 12, further comprising second heat transfer medium passage switching devices each connected to the passage on the inlet side of one of the plurality of second heat exchangers, each of the second heat transfer medium passage switching devices configured to select one of the second heat exchangers which communicates with the passage on the outlet side of the use side heat exchanger.

14. The air-conditioning apparatus of claim 1, wherein the heat transfer medium passage reversing device is a three-way valve or a plurality of two-way valves disposed at each of one end and the other end of the heat transfer medium passage of the second heat exchanger.

15. The air-conditioning apparatus of claim 14, wherein the heat transfer medium passage reversing device includes a first heat transfer medium passage reversing device disposed at the one end of the heat transfer medium passage of the second heat exchanger and connected to the other end of the heat transfer medium passage of the second heat exchanger by pipes at a first connection port, and a second heat transfer medium passage reversing device disposed at the other end of the heat transfer medium passage of the second heat exchanger and connected to the one end of the heat transfer medium passage of the second heat exchanger by pipes at a second connection port, wherein the first connection port is disposed in a passage between the other end of the heat transfer medium passage of the second heat exchanger and the second heat transfer medium passage reversing device, and wherein the second connection port is disposed in a passage between the one end of the heat transfer medium passage of the second heat exchanger and the first heat transfer medium passage reversing device.

16. The air-conditioning apparatus of claim 1, wherein the refrigerant is a refrigerant mixture containing at least tetrafluoropropene and R32.

17. The air-conditioning apparatus of claim 16, wherein the refrigerant is a refrigerant mixture containing at least HFO1234yf and R32, and R32 is mixed at a proportion ranging from 3 mass % to 45 mass %.

* * * * *